US009019163B2

(12) United States Patent
Asanuma et al.

(10) Patent No.: US 9,019,163 B2
(45) Date of Patent: Apr. 28, 2015

(54) SMALL ANTENNA APPARATUS OPERABLE IN MULTIPLE BANDS INCLUDING LOW-BAND FREQUENCY AND HIGH-BAND FREQUENCY WITH ULTRA WIDE BANDWIDTH

(75) Inventors: Kenichi Asanuma, Kyoto (JP); Atsushi Yamamoto, Kyoto (JP); Tsutomu Sakata, Osaka (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 204 days.

(21) Appl. No.: 13/989,460

(22) PCT Filed: Aug. 31, 2012

(86) PCT No.: PCT/JP2012/005538

§ 371 (c)(1),
(2), (4) Date: May 24, 2013

(87) PCT Pub. No.: WO2013/061502

PCT Pub. Date: May 2, 2013

(65) Prior Publication Data

US 2013/0249753 A1 Sep. 26, 2013

(30) Foreign Application Priority Data

Oct. 27, 2011 (JP) ..... 2011-235902

(51) Int. Cl.
*H01Q 5/00* (2006.01)
*H01Q 9/42* (2006.01)
(Continued)

(52) U.S. Cl.
CPC ..... *H01Q 5/0024* (2013.01); *H01Q 9/42* (2013.01); *H01Q 7/005* (2013.01); *H01Q 9/065* (2013.01); *H01Q 9/28* (2013.01); *H01Q 5/321* (2015.01)

(58) Field of Classification Search
CPC ..... H01Q 9/42; H01Q 5/0024; H01Q 9/28; H01Q 7/005; H01Q 9/065; H01Q 5/321
USPC ..... 343/702, 748, 749, 866, 745, 741, 744
See application file for complete search history.

(56) References Cited

U.S. PATENT DOCUMENTS 6,529,170 B1 3/2003 Nishizawa et al.
8,933,853 B2 * 1/2015 Asanuma et al. ..... 343/749
(Continued)

FOREIGN PATENT DOCUMENTS

JP 08-213820 8/1996
JP 2001-185938 7/2001
(Continued)

OTHER PUBLICATIONS

International Search Report issued Oct. 9, 2012 in International (PCT) Application No. PCT/JP2012/005538.
(Continued)

*Primary Examiner* — Hoanganh Le
(74) *Attorney, Agent, or Firm* — Wenderoth, Lind & Ponack, L.L.P.

(57) ABSTRACT

A radiator includes a looped radiation conductor, a capacitor, an inductor, and a feed point on a radiation conductor. In a portion where the radiation conductor and a ground conductor are close to each other, a distance between the radiation conductor and the ground conductor gradually increases as a distance from the feed point along the looped radiation conductor increases. When the radiator is excited at a low-band resonance frequency, a current flows along a first path extending along an inner perimeter of the looped radiation conductor and including the inductor and the capacitor. When the radiator is excited at a high-band resonance frequency, a second current flows through a second path including a section extending along an outer perimeter of the looped radiation conductor, and the section including the capacitor but not including the inductor, and the section extending between the feed point and the inductor.

20 Claims, 35 Drawing Sheets

(51) Int. Cl.

| | |
|---|---|
| ***H01Q 7/00*** | (2006.01) |
| ***H01Q 9/06*** | (2006.01) |
| ***H01Q 9/28*** | (2006.01) |

(56) References Cited

U.S. PATENT DOCUMENTS

| | | | | |
|---|---|---|---|---|
| 2003/0034917 | A1 | 2/2003 | Nishizawa et al. | |
| 2009/0295653 | A1* | 12/2009 | Komura | 343/702 |
| 2009/0303136 | A1 | 12/2009 | Kuramoto et al. | |
| 2010/0149053 | A1* | 6/2010 | Nakano et al. | 343/702 |
| 2011/0148718 | A1* | 6/2011 | Wang et al. | 343/702 |

FOREIGN PATENT DOCUMENTS

| | | |
|---|---|---|
| JP | 2009-111999 | 5/2009 |
| JP | 2009-206847 | 9/2009 |
| JP | 2009-239463 | 10/2009 |
| JP | 2010-041359 | 2/2010 |
| JP | 4432254 | 3/2010 |
| WO | 2007/091578 | 8/2007 |
| WO | 2010/137061 | 12/2010 |

OTHER PUBLICATIONS

International Preliminary Report on Patentability and Written Opinion of the International Searching Authority issued May 8, 2014 in International (PCT) Application No. PCT/JP2012/005538.

* cited by examiner

SMALL ANTENNA APPARATUS OPERABLE IN MULTIPLE BANDS INCLUDING LOW-BAND FREQUENCY AND HIGH-BAND FREQUENCY WITH ULTRA WIDE BANDWIDTH

TECHNICAL FIELD

The present disclosure relates to an antenna apparatus mainly for use in mobile communication such as mobile phones, and relates to a wireless communication apparatus provided with the antenna apparatus.

BACKGROUND ART

The size and thickness of portable wireless communication apparatuses, such as mobile phones, have been rapidly reduced. In addition, the portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In such circumstances, there are proposed a multiband antenna apparatus and a small antenna apparatus, each supporting a plurality of wireless communication schemes. Further, there is proposed an array antenna apparatus capable of reducing electromagnetic couplings among antenna apparatuses each corresponding to the above mentioned one, and thus, performing high-speed wireless communication.

According to an invention of Patent Literature 1, a two-frequency antenna is characterized by: a feeder, an inner radiation element connected to the feeder, and an outer radiation element, all of which are printed on a first surface of a dielectric substrate; an inductor formed in a gap between the inner radiation element and the outer radiation element printed on the first surface of the dielectric substrate to connect the two radiation elements; a feeder, an inner radiation element connected to the feeder, and an outer radiation element, all of which are printed on a second surface of the dielectric substrate; and an inductor formed in a gap between the inner radiation element and the outer radiation element printed on the second surface of the dielectric substrate to connect the two radiation elements. The two-frequency antenna of Patent Literature 1 is operable in multiple bands by forming a parallel resonant circuit from the inductor provided between the radiation elements and a capacitance between the radiation elements.

An invention of Patent Literature 2 is characterized by forming a looped radiation element, and bringing its open end close to a feeding portion to form a capacitance, thus a fundamental mode and its harmonic modes occur. By integrally forming a looped radiation element on a dielectric or magnetic block, it is possible to operate in multiple bands, while having a small size.

CITATION LIST

Patent Literature

PATENT LITERATURE 1: Japanese Patent Laid-open Publication No. 2001-185938

PATENT LITERATURE 2: Japanese Patent No. 4432254

SUMMARY OF INVENTION

Technical Problem

In recent years, there has been an increasing need to increase the data transmission rate on mobile phones, and thus, a next generation mobile phone standard, 3G-LTE (3rd Generation Partnership Project Long Term Evolution) has been studied. According to 3G-LTE, as a new technology for an increased the wireless transmission rate, it is determined to use a MIMO (Multiple Input Multiple Output) antenna apparatus using a plurality of antennas to simultaneously transmit or receive radio signals of a plurality of channels by spatial division multiplexing. The MIMO antenna apparatus uses a plurality of antennas at each of a transmitter and a receiver, and spatially multiplexes data streams, thus increasing a transmission rate. Since the MIMO antenna apparatus uses the plurality of antennas so as to simultaneously operate at the same frequency, electromagnetic coupling among the antennas becomes very strong under circumstances where the antennas are disposed close to each other within a small-sized mobile phone. When the electromagnetic coupling among the antennas is strong, the radiation efficiency of the antennas degrades. Therefore, received radio waves are weakened, resulting in a reduced transmission rate. Hence, it is necessary to provide a technique for reducing electromagnetic couplings among the antennas, by reducing the antennas' size to substantially increase the distances among the antennas.

In addition, in order to use a single antenna for a plurality of wireless systems such as GPS, cellular, and wireless LAN, it is necessary to develop an antenna having a very wide operating bandwidth (ultra wide band).

According to the two-frequency antenna of Patent Literature 1, if decreasing the low-band operating frequency, the size of the radiation elements should be increased. In addition, no contribution to radiation is made by slits between the inner radiation elements and the outer radiation elements.

The multiband antenna of Patent Literature 2 achieves the reduction of the antenna's size by providing a loop element on a dielectric or magnetic block. However, since the antenna's impedance decreases due to the dielectric or magnetic block, the radiation characteristics degrades in resonance frequency bands for the fundamental mode and its harmonic modes. In addition, an antenna with such a configuration has a high Q value of the antenna resonance, and thus, cannot have an operating frequency band with an ultra wide bandwidth.

Therefore, it is desired to provide an antenna apparatus capable of easily achieve an operating frequency band with an ultra wide bandwidth, and capable of achieving both multiband operation and size reduction.

The present disclosure solves the above-described problems, and provides an antenna apparatus capable of achieving both multiband operation and size reduction, and also provides a wireless communication apparatus provided with such an antenna apparatus.

Solution to Problem

According to an aspect of the present disclosure, an antenna apparatus is provided with at least one radiator and a ground conductor. Each radiator is provided with: a looped radiation conductor having an inner perimeter and an outer perimeter, the radiation conductor being positioned with respect to the ground conductor such that a part of the radiation conductor is close to and electromagnetically coupled to the ground conductor; at least one capacitor inserted at a position along a loop of the radiation conductor; at least one inductor inserted at a position along the loop of the radiation conductor, the position of the inductor being different from the position of the capacitor; and a feed point provided at a position on the radiation conductor, the position of the feed point being close to the ground conductor. The antenna apparatus is configured such that in a portion where the radiation conductor of each radiator and the ground conductor are close to each other, a distance between the radiation conductor and the ground conductor gradually increases as a distance from the feed point along the loop of the radiation conductor increases. Each radiator is excited at a first frequency and at a second frequency higher than the first frequency. When each radiator is excited at the first frequency, a first current flows along a first path, the first path extending along the inner perimeter of the loop of the radiation conductor and including the inductor and the capacitor. When each radiator is excited at the second frequency, a second current flows through a second path including a section, the section extending along the outer perimeter of the loop of the radiation conductor, and the section including the capacitor but not including the inductor, and the section extending between the feed point and the inductor. When each radiator is excited at the second frequency, in the portion where the radiation conductor of each radiator and the ground conductor are close to each other, a resonant circuit is formed from: capacitance distributed between the radiation conductor and the ground conductor; and inductance distributed over the radiation conductor. Each radiator is configured such that the loop of the radiation conductor, the inductor, and the capacitor resonate at the first frequency, and a portion of the loop of the radiation conductor included in the second path, the capacitor, and the resonant circuit resonate at the second frequency.

Advantageous Effects of Invention

According to the antenna apparatus of the present disclosure, it is possible to provide an antenna apparatus operable in multiple bands, while having a simple and small configuration. In addition, according to the antenna apparatus of the present disclosure, it is possible to achieve a high operating frequency band with an ultra wide bandwidth.

DESCRIPTION OF EMBODIMENTS

Antenna apparatuses and wireless communication apparatuses according to embodiments will be described below with reference to the drawings. Like components are denoted by the same reference signs.

First Embodiment

Figure 1:
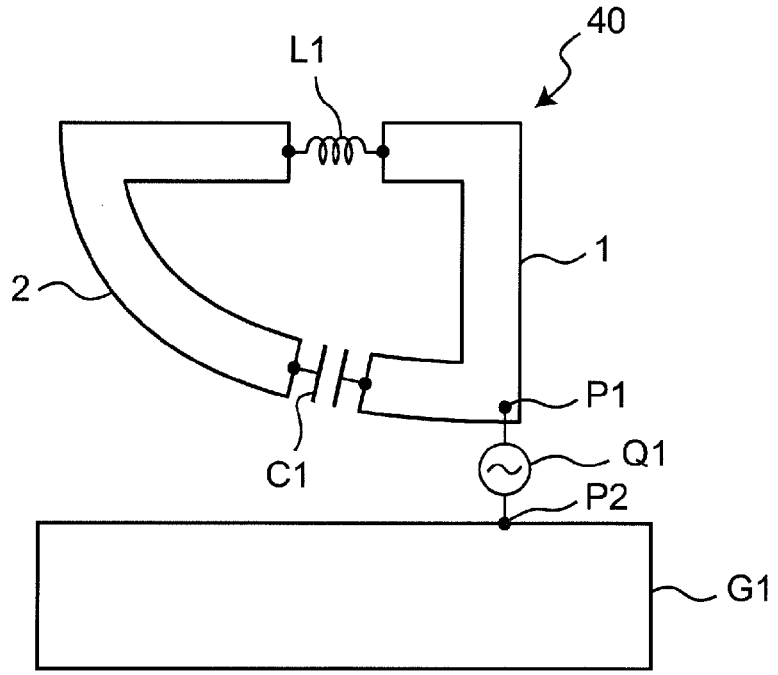
FIG. 1 is a schematic diagram showing an antenna apparatus according to a first embodiment.

FIG. 1 is a schematic diagram showing an antenna apparatus according to a first embodiment. The antenna apparatus of the present embodiment is characterized in that the antenna apparatus operates at dual bands, including a low-band resonance frequency f1 and a high-band resonance frequency f2, using a single radiator 40, and that a high frequency operating band including the high-band resonance frequency f2 has an ultra wide bandwidth.

Referring to FIG. 1, the radiator 40 is provided with: a first radiation conductor 1 having a certain width and a certain electrical length; a second radiation conductor 2 having a certain width and a certain electrical length; a capacitor C1 connecting the radiation conductors 1 and 2 to each other at a position; and an inductor L1 connecting the radiation conductors 1 and 2 to each other at another position different from that of the capacitor C1. In the radiator 40, the radiation conductors 1 and 2, the capacitor C1, and the inductor L1 form a loop surrounding a central portion. In other words, the capacitor C1 is inserted at a position along the looped radiation conductor, and the inductor L1 is inserted at another position different from the position where the capacitor C1 is inserted. The looped radiation conductor has a width, and thus, has an inner perimeter close to the central hollow portion, and an outer perimeter remote from the central hollow portion. Further, the looped radiation conductor is positioned with respect to a ground conductor G1, such that a part of the radiation conductor is close to the ground conductor G1 so as to be electromagnetically coupled to the ground conductor G1. A signal source Q1 generates a radio frequency signal of the low-band resonance frequency f1 and a radio frequency signal of the high-band resonance frequency f2. The signal source Q1 is connected to a feed point P1 on the radiation conductor 1, and is connected to a connecting point P2 on a ground conductor G1 provided close to the radiator 40. The feed point P1 is provided at a position on the radiation conductor 1, the position being close to the ground conductor G1. The signal source Q1 schematically shows a wireless communication circuit connected to the antenna apparatus of FIG. 1, and excites the radiator 40 at one of the low-band resonance frequency f1 and the high-band resonance frequency f2. If necessary, a matching circuit (not shown) may be further connected between the antenna apparatus and the wireless communication circuit. Further, the antenna apparatus is characterized in that in a portion where the radiation conductors 1, 2 and the ground conductor G1 are close to each other, the distance between the radiation conductors 1, 2 and the ground conductor G1 gradually increases as the distance from the feed point P1 along the looped radiation conductor increases. Hence, the outer perimeter of the looped radiation conductor is shaped such that in a portion where the radiation conductors 1, 2 and the ground conductor G1 are close to each other (e.g., a portion where the radiation conductors 1, 2 and the ground conductor G1 are opposed to each other), the distance from the ground conductor G1 thereto gradually increases as the distance from the feed point P1 along the loop of the radiation conductor increases. In the radiator 40, a current path for the case where the radiator 40 is excited at the low-band resonance frequency f1 is different from a current path for the case where the radiator 40 is excited at the high-band resonance frequency f2, and thus, it is possible to effectively achieve dual-band operation.

Figure 2:
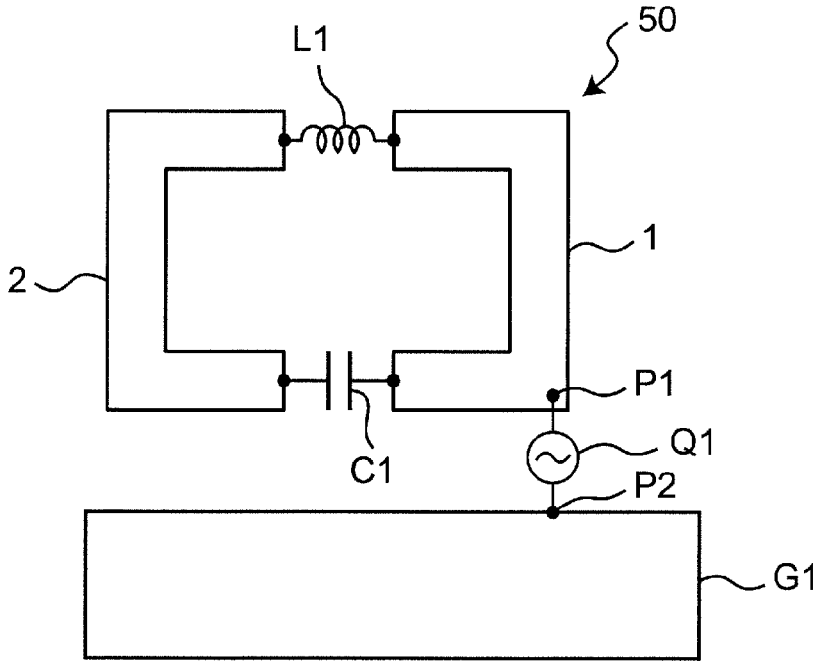
FIG. 2 is a schematic diagram showing an antenna apparatus according to a comparison example of the first embodiment.

FIG. 2 is a schematic diagram showing an antenna apparatus according to a comparison example of the first embodiment. The applicant of the present application proposed, in the International Application No. PCT/JP2012/000500, an antenna apparatus characterized by a single radiator operable in dual bands, and FIG. 2 shows that antenna apparatus. A radiator 50 of FIG. 2 has the same configuration as that of the radiator 40 of FIG. 1, except that an outer perimeter of a looped radiation conductor is not shaped such that in a portion where radiation conductors 1, 2 and a ground conductor G1 are close to each other, the distance from the ground conductor G1 thereto gradually increases as the distance from a feed point P1 along the loop of the radiation conductor increases. In the radiator 50, a current path for the case where the radiator 50 is excited at the low-band resonance frequency f1 is different from a current path for the case where the radiator 50 is excited at the high-band resonance frequency f2, and thus, it is possible to effectively achieve dual-band operation.

Figure 3:
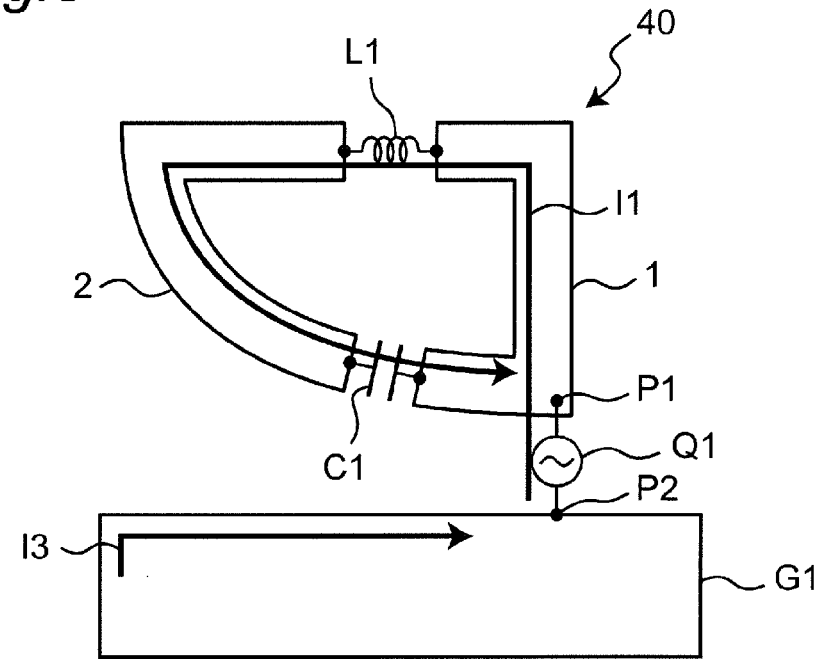
FIG. 3 is a diagram showing a current path for the case where the antenna apparatus of FIG. 1 operates at a low-band resonance frequency f1.

FIG. 3 is a diagram showing a current path for the case where the antenna apparatus of FIG. 1 operates at the low-band resonance frequency f1. By nature, a current having a low frequency component can pass through an inductor (low impedance), but is difficult to pass through a capacitor (high impedance). Hence, a current I1, for the case where the antenna apparatus operates at the low-band resonance frequency f1, flows along a path extending along the inner perimeter of the looped radiation conductor and including the inductor L1. Specifically, the current I1 flows through a portion of the radiation conductor 1 from the feed point P1 to a point connected to the inductor L1, passes through the inductor L1, and flows through a portion of the radiation conductor 2 from a point connected to the inductor L1, to a point connected to the capacitor C1. Further, due to the voltage difference across both ends of the capacitor, a current flows through a portion of the radiation conductor 1 from a point connected to the capacitor C1, to the feed point P1, and is connected to the current I1. Hence, it can be considered that the current I1 substantially also passes through the capacitor C1. The current I1 flows strongly along an edge of the inner perimeter of the looped radiation conductor, close to the central hollow portion. In addition, a current I3 flows along a portion of the ground conductor G1, the portion being close to the radiator 40, and flows toward the connecting point P2. The radiator 40 is configured such that when the antenna apparatus operates at the low-band resonance frequency f1, the current I1 flows along the current path as shown in FIG. 3, and the looped radiation conductor, the inductor L1, and the capacitor C1 resonate at the low-band resonance frequency f1. Specifically, the radiator 40 is configured such that the sum of an electrical length of the portion of the radiation conductor 1 from the feed point P1 to the point connected to the inductor L1, an electrical length of the portion of the radiation conductor 1 from the feed point P1 to the point connected to the capacitor C1, an electrical length of the inductor L1, an electrical length of the capacitor C1, and an electrical length of the portion of the radiation conductor 2 from the point connected to the inductor L1 to the point connected to the capacitor C1 is equal to an electrical length at which the antenna apparatus resonates at the low-band resonance frequency f1. The electrical length at which the antenna apparatus resonates is, for example, 0.2 to 0.25 times of an operating wavelength λ1 of the low-band resonance frequency f1. When the antenna apparatus operates at the low-band resonance frequency f1, the current I1 flows along the current path as shown in FIG. 3, and accordingly, the radiator 40 operates in a loop antenna mode, i.e., a magnetic current mode.

Since the radiator 40 operates in the loop antenna mode, it is possible to achieve a long resonant length while maintaining a small size, thus achieving good characteristics even when the antenna apparatus operates at the low-band resonance frequency f1. In addition, when the radiator 40 operates in the loop antenna mode, the radiator 40 has a high Q value. The larger the diameter of the looped radiation conductor is, the more the radiation efficiency of the antenna apparatus improves.

Figure 4:
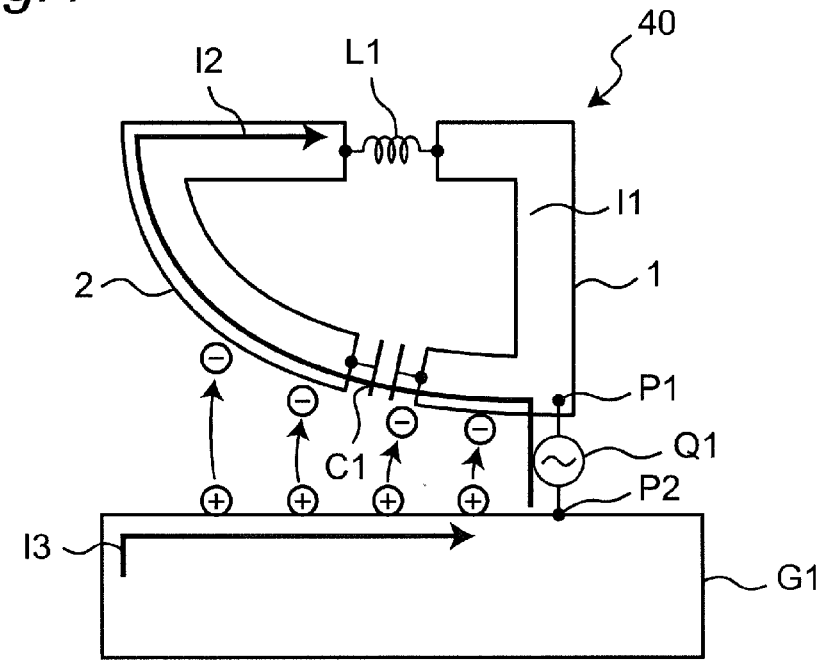
FIG. 4 is a diagram showing a current path for the case where the antenna apparatus of FIG. 1 operates at a high-band resonance frequency f2.

FIG. 4 is a diagram showing a current path for the case where the antenna apparatus of FIG. 1 operates at the high-band resonance frequency f2. By nature, a current having a high frequency component can pass through a capacitor (low impedance), but is difficult to pass through an inductor (high impedance). Hence, a current I2, for the case where the antenna apparatus operates at the high-band resonance frequency f2, flows along a path including a section, the section extending along the outer perimeter of the looped radiation conductor, and the section including the capacitor C1 but not including the inductor L1, and the section extending between the feed point P1 and the inductor L1. Specifically, the current I2 flows through a portion of the radiation conductor 1 from the feed point P1 to a point connected to the capacitor C1, passes through the capacitor C1, and flows through a portion of the radiation conductor 2 from a point connected to the capacitor C1, to a certain position (e.g., a point connected to the inductor L1). At this time, the current I2 strongly flows through the outer perimeter of the looped radiation conductor. In addition, a current I3 flows along a portion of the ground conductor G1, the portion being close to the radiator 40, and flows toward the connecting point P2 (i.e., in a direction opposite to that of the current I2). Therefore, the currents I2 and I3 of opposite phases flow through the portion where the looped radiation conductor and the ground conductor G1 are close to each other. Considering the currents I2 and I3 of opposite phases as electric charges, positive and negative charges are distributed in the portion where the looped radiation conductor and the ground conductor G1 are close to each other, as shown in FIG. 4, and the charges vary over time according to the polarity of the drive voltage of the signal source Q1. In this case, electric flux as indicated by arrows in the drawing is produced between the looped radiation conductor and the ground conductor G1. Accordingly, it is equivalent to provide continuously distributed parallel capacitors between the looped radiation conductor and the ground conductor G1. In a portion where the radiation conductors 1, 2 and the ground conductor G1 are close to each other, a resonant circuit is formed from: capacitance distributed between the radiation conductors 1, 2 and the ground conductor G1; and inductance distributed over the radiation conductors 1 and 2. By the resonant circuit, matching of the radiator 40 is achieved.

Figure 5:
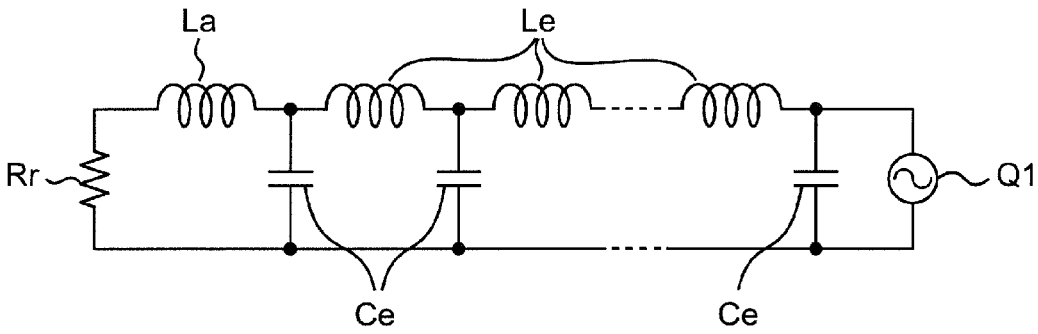
FIG. 5 is a diagram showing an equivalent circuit for the case where the antenna apparatus of FIG. 1 operates at the high-band resonance frequency f2.

FIG. 5 is a diagram showing an equivalent circuit for the case where the antenna apparatus of FIG. 1 operates at the high-band resonance frequency f2. When the antenna apparatus operates at the high-band resonance frequency f2, the current I2 flows as shown in FIG. 4. Accordingly, in a portion where the radiation conductors 1, 2 and the ground conductor G1 are close to each other, micro capacitances Ce are continuously distributed along the looped radiation conductor and between the radiation conductors 1, 2 and the ground conductor G1. Further, in the portion where the radiation conductors 1, 2 and the ground conductor G1 are close to each other, micro inductances Le are continuously distributed along the looped radiation conductor. Therefore, when the antenna apparatus operates at the high-band resonance frequency f2, the input impedance of the antenna apparatus is determined by the radiation resistance Rr of the antenna apparatus, the inductance La of a portion of the looped radiation conductor, the portion being remote from the ground conductor G1 (i.e., a tip of the radiation conductor 2), the micro inductances Le, and the micro capacitances Ce. As a result, a wide band resonant circuit is formed from the inductance La and Le and the capacitance Ce, and thus, it is possible to achieve the high frequency operating band, including the high-band resonance frequency f2, with an ultra wide bandwidth.

The radiator 40 is configured such that when the antenna apparatus operates at the high-band resonance frequency f2, the current I2 flows along the current path as shown in FIG. 4, and the portion of the looped radiation conductor through which the current I2 flows, the capacitor C1, and the above-described resonant circuit (FIG. 5) resonate at the high-band resonance frequency f2. Specifically, the radiator 40 is configured such that, taking into account the matching due to the above-described resonant circuit, the sum of an electrical length of the portion of the radiation conductor 1 from the feed point P1 to the point connected to the capacitor C1, an electrical length of the capacitor C1, and an electrical length of the portion of the radiation conductor 2 through which the current I2 flows (e.g., an electrical length of the portion of the radiation conductor 2 from the point connected to the capacitor C1 to the point connected to the inductor L1) is equal to an electrical length at which the antenna apparatus resonates at the high-band resonance frequency f2. The electrical length at which the antenna apparatus resonates is, for example, 0.25 times of an operating wavelength λ2 of the high-band resonance frequency f2. When the antenna apparatus operates at the high-band resonance frequency f2, the current I2 flows along the current path as shown in FIG. 4, and accordingly, the radiator 40 operates in a monopole antenna mode, i.e., an electric current mode.

As described above, the antenna apparatus of the present embodiment forms a current path passing through the inductor L1, when operating at the low-band resonance frequency f1, and forms a current path passing through the capacitor C1, when operating at the high-band resonance frequency f2, and thus, the antenna apparatus effectively achieves dual-band operation. The radiator 40 forms a looped current path, and thus, operates in a magnetic current mode, and resonates at the low-band resonance frequency f1. On the other hand, the radiator 40 forms a non-looped current path (monopole antenna mode), and thus, operates in an electric current mode, and resonates at the high-band resonance frequency f2. Further, since the outer perimeter of the looped radiation conductor is shaped such that in a portion where the radiation conductors 1, 2 and the ground conductor G1 are close to each other, the distance from the ground conductor G1 thereto gradually increases as the distance from the feed point P1 along the loop of the radiation conductor increases (tapered form), it is possible to achieve the high frequency operating band, including the high-band resonance frequency f2, with an ultra wide bandwidth.

According to the prior art, when an antenna apparatus operates at the low-band resonance frequency f1 (operating wavelength λ1), an antenna element length of about (λ1)/4 is required. On the other hand, the antenna apparatus of the present embodiment forms the looped current path, and accordingly, the lengths in the horizontal and vertical directions of the radiator 40 can be reduced to about (λ1)/15.

Now, a matching effect brought about by the inductor L1 and the capacitor C1 of the antenna apparatus of FIG. 1 will be described. The low-band resonance frequency f1 and the high-band resonance frequency f2 can be adjusted using a matching effect brought about by the inductor L1 and the capacitor C1 (particularly, a matching effect brought about by the capacitor C1). When the antenna apparatus operates at the low-band resonance frequency f1, the current flowing through the portion of the radiation conductor 2 from the point connected to the inductor L1 to the point connected to the capacitor C1, and the current flowing through the portion of the radiation conductor 1 from the point connected to the capacitor C1 to the feed point P1 are connected to the current flowing through the portion of the radiation conductor 1 from the feed point P1 to the point connected to the inductor L1, and accordingly, the looped current path is formed. Since the voltage difference appears across both ends of the capacitor C1 (on the side of the radiation conductor 1 and the side of the radiation conductor 2), there is an effect of controlling the reactance component of the input impedance of the antenna apparatus by the capacitance of the capacitor C1. The larger the capacitance of the capacitor C1, the lower the resonance frequency of the radiator 40. On the other hand, when the antenna apparatus operates at the high-band resonance frequency f2, the current flows through the portion of the radiation conductor 1 from the feed point P1 to the point connected to the capacitor C1, passes through the capacitor C1, and flows through the portion of the radiation conductor 2 from the point connected to the capacitor C1 to the point connected to the inductor L1. Since the capacitor C1 passes a high frequency component, reduction in the capacitance of the capacitor C1 results in a shortened electrical length, and thus, the resonance frequency of the radiator 40 shifts to a higher frequency. Since the voltage at the feed point P1 is the minimum in the radiator 40, the resonance frequency of the radiator 40 can be decreased by increasing a distance of the capacitor C1 from the feed point P1.

According to the antenna apparatus of FIG. 1, the capacitor C1 is closer to the feed point P1 than the inductor L1. Hence, since the current I2 flows from the feed point P1 to the inductor L1 (i.e., the open end is remote from the ground conductor G1) when the antenna apparatus of FIG. 1 operates at the high-band resonance frequency f2, the VSWR is lower than that for the case where the antenna apparatus operates at the low-band resonance frequency f1, and thus, the matching can be more easily achieved.

The radiation efficiency of the antenna apparatus is improved by increasing a distance between the capacitor C1 and the inductor L1 of the radiator to form a large loop.

The antenna apparatus of the present embodiment can use 800 MHz band frequencies as the low-band resonance frequency f1, and use 2000 MHz band frequencies as the high-band resonance frequency f2, as will be described in implementation examples which will be described later. However, the frequencies are not limited thereto.

Each of the radiation conductors 1 and 2 is not limited to be shaped in a strip as shown in FIG. 1, etc., and may have any shape, as long as a certain electrical length can be obtained between the capacitor C1 and the inductor L1.

According to the antenna apparatus of FIG. 1, a plane including the radiator 40 is the same as a plane including the ground conductor G1. However, the arrangement of the radiator 40 and the ground conductor G1 is not limited thereto. The radiator 40 and the ground conductor G1 are arranged in any manner, as long as in a portion where the radiation conductors 1, 2 and the ground conductor G1 are close to each other, the distance between the radiation conductors 1, 2 and the ground conductor G1 gradually increases as the distance from the feed point P1 along the looped radiation conductor increases. For example, the plane including the radiator 40 may have a certain angle with respect to the plane including the ground conductor G1.

Since the antenna apparatus of the present embodiment is provided with the radiator 40 operable in one of the loop antenna mode and the monopole antenna mode according to the operating frequency, it is possible to effectively achieve dual-band operation, and achieve the size reduction of the antenna apparatus. Further, it is possible to achieve the high frequency operating band, including the high-band resonance frequency f2, with an ultra wide bandwidth.

Figure 6:
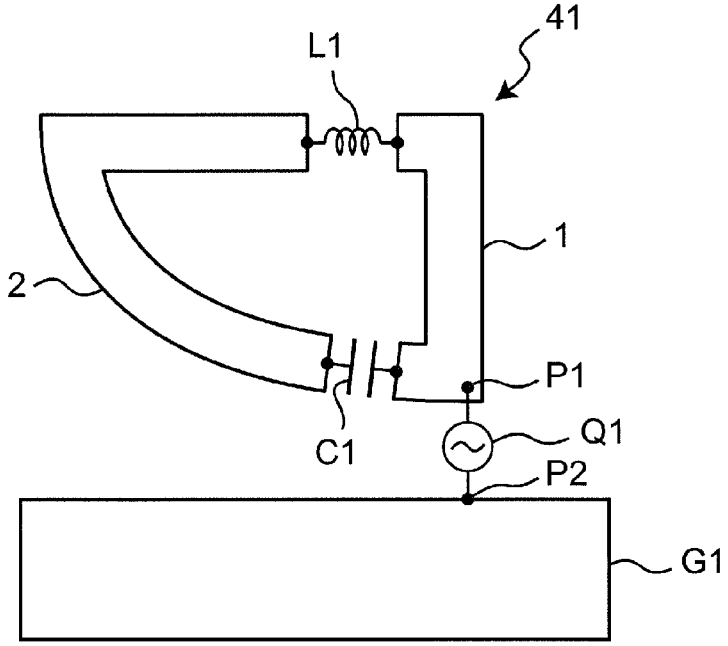
FIG. 6 is a schematic diagram showing an antenna apparatus according to a first modified embodiment of the first embodiment.
Figure 7:
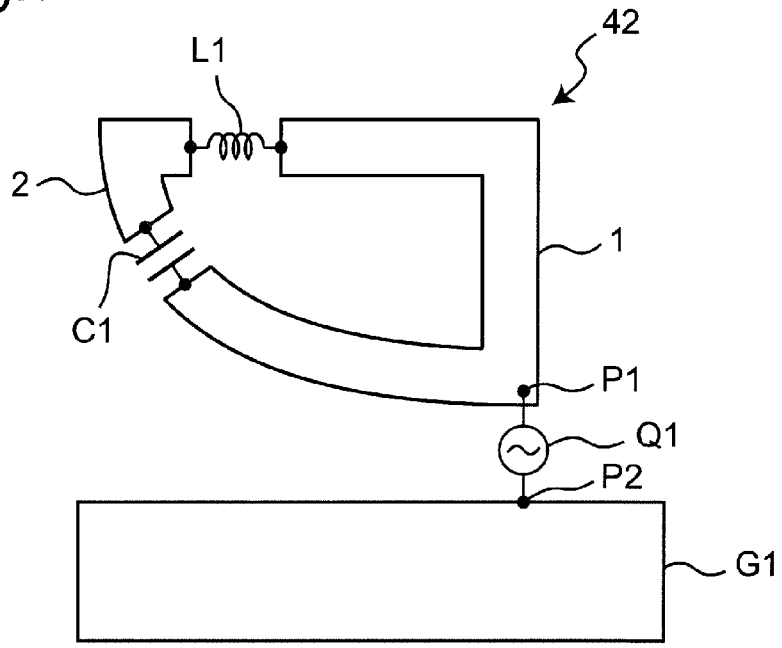
FIG. 7 is a schematic diagram showing an antenna apparatus according to a second modified embodiment of the first embodiment.

FIG. 6 is a schematic diagram showing an antenna apparatus according to a first modified embodiment of the first embodiment. FIG. 7 is a schematic diagram showing an antenna apparatus according to a second modified embodiment of the first embodiment. A method for adjusting the resonance frequency of the antenna apparatus can be summarized as follows. In order to reduce the low-band resonance frequency f1, it is effective to increase the capacitance of the capacitor C1, increase the inductance of the inductor L1, increase the electrical length of the radiation conductor 1, or increase the electrical length of the radiation conductor 2, etc. In order to reduce the high-band resonance frequency f2, it is effective to increase the electrical length of the radiation conductor 2, or increase the distance of the capacitor C1 from the feed point P1, etc. FIG. 6 shows an antenna apparatus provided with a radiator 41, which is configured to reduce the low-band resonance frequency f1. According to the antenna apparatus of FIG. 6, the low-band resonance frequency f1 is reduced by increasing the electrical length of a radiation conductor 2. FIG. 7 shows an antenna apparatus provided with a radiator 42, which is configured to reduce the high-band resonance frequency f2. According to the antenna apparatus of FIG. 7, the high-band resonance frequency f2 is reduced by increasing the distance of a capacitor C1 from a feed point P1.

In order to surely change the operation of the antenna apparatus between the magnetic current mode and the electric current mode, it is necessary to provide a clear difference between the respective electrical lengths of the current paths for the cases where the antenna apparatus operates at the low-band resonance frequency f1 and the high-band resonance frequency f2. To this end, it is preferred that the electrical length of the radiation conductor 2 be longer than that of the radiation conductor 1. In addition, by reducing the electrical lengths on the radiation conductor 1 from the feed point P1 to the inductor L1 and from the feed point P1 to the capacitor C1, a current tends to flow from the feed point P1 to the inductor L1 when the antenna apparatus operates at the low-band resonance frequency f1, and a current tends to flow from the feed point P1 to the capacitor C1 when the antenna apparatus operates at the high-band resonance frequency f2, and thus, any current is less like to flow in unwanted directions.

Figure 8:
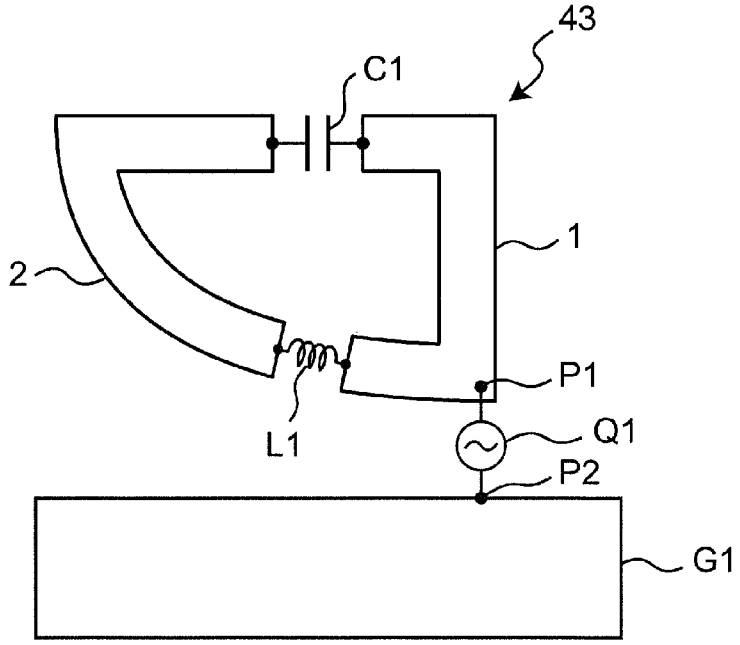
FIG. 8 is a schematic diagram showing an antenna apparatus according to a third modified embodiment of the first embodiment.

FIG. 8 is a schematic diagram showing an antenna apparatus according to a third modified embodiment of the first embodiment. According to the antenna apparatus of FIG. 1, the capacitor Cl is closer to the feed point P1 than the inductor L1. On the other hand, according to the antenna apparatus of FIG. 8, an inductor L1 is provided closer to a feed point P1 than a capacitor C1. Hence, since a current I1 flows from the feed point P1 at first to the capacitor C1 (i.e., the open end is remote from a ground conductor G1) when the antenna apparatus of FIG. 8 operates at the low-band resonance frequency f1, the VSWR is lower than that for the case where the antenna apparatus operates at the high-band resonance frequency f2, and thus, the matching can be more easily achieved. Since the antenna apparatus of FIG. 8 is also provided with the radiator 43 operable in one of the loop antenna mode and the monopole antenna mode according to the operating frequency, it is possible to effectively achieve dual-band operation, and achieve the size reduction of the antenna apparatus. Further, also according to the antenna apparatus of FIG. 8, it is possible to achieve the high frequency operating band, including the high-band resonance frequency f2, with an ultra wide bandwidth.

Figure 9:
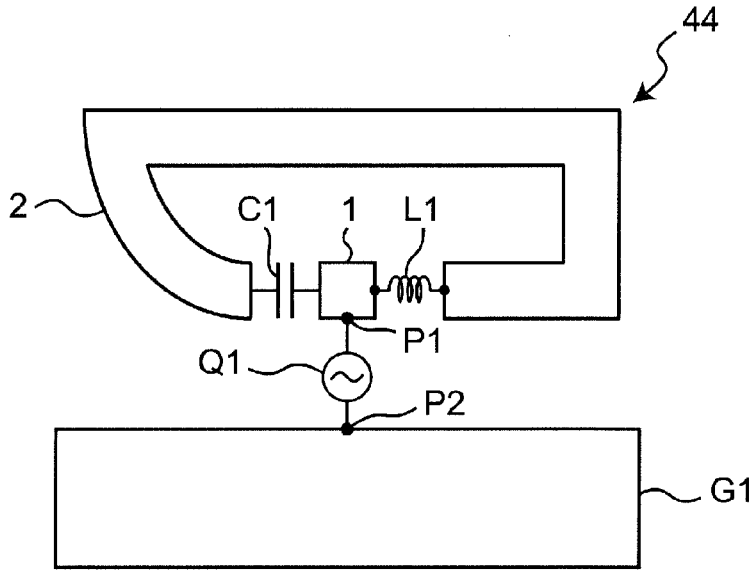
FIG. 9 is a schematic diagram showing an antenna apparatus according to a fourth modified embodiment of the first embodiment.

FIG. 9 is a schematic diagram showing an antenna apparatus according to a fourth modified embodiment of the first embodiment. A capacitor C1 and an inductor L1 of a radiator 44 are respectively provided along a looped radiation conductor and at a portion where the radiation conductor and a ground conductor G1 are close to each other. A feed point P1 is provided between the capacitor C1 and the inductor L1. The antenna apparatus of FIG. 9 is configured such that both the capacitor C1 and the inductor L1 are close to the ground conductor G1, and accordingly, a current path for the case where the antenna apparatus operates at the low-band resonance frequency f1 is separated from a current path for the case where the antenna apparatus operates at the high-band resonance frequency f2, and thus, their open ends are remote from the ground conductor G1. Therefore, the VSWR is low at both the low-band resonance frequency f1 and the high-band resonance frequency f2, and accordingly, the matching can be easily achieved. Further, according to the antenna apparatus of FIG. 9, the outer perimeter of the looped radiation conductor is shaped such that in a portion where radiation conductors 1, 2 and the ground conductor G1 are close to each other, the distance from the ground conductor G1 thereto gradually increases as the distance from the feed point P1 along the loop of the radiation conductor increases in at least one direction, preferably, as proceeding in a direction from the feed point P1 to the capacitor C1 (as proceeding to the left). According to the antenna apparatus of FIG. 9, the outer perimeter of the looped radiation conductor is shaped such that in a portion where the radiation conductors 1, 2 and the ground conductor G1 are close to each other, the distance from the ground conductor G1 thereto gradually increases as proceeding to left from the feed point P1, and accordingly, it is possible to achieve the high frequency operating band, including the high-band resonance frequency f2, with an ultra wide bandwidth, while equally achieving both the matching for the case where the antenna apparatus operates at the low-band resonance frequency f1 and for the case where the antenna apparatus operates at the high-band resonance frequency f2.

Figure 10:
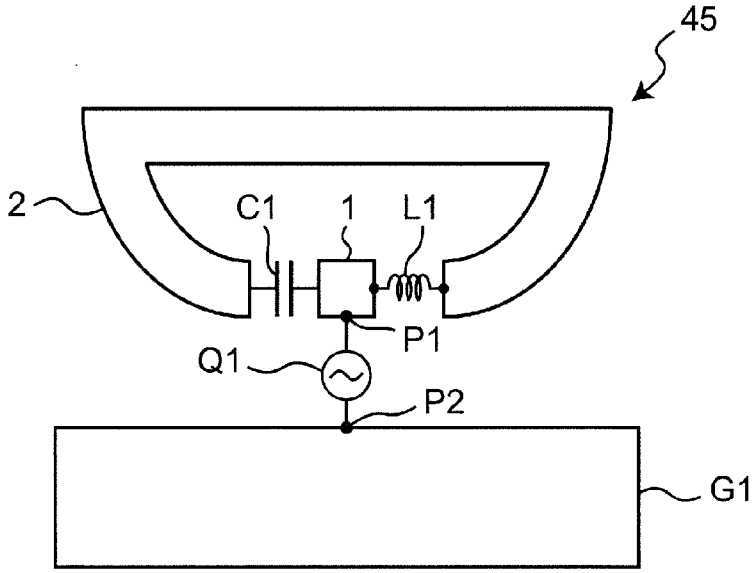
FIG. 10 is a schematic diagram showing an antenna apparatus according to a fifth modified embodiment of the first embodiment.

FIG. 10 is a schematic diagram showing an antenna apparatus according to a fifth modified embodiment of the first embodiment. According to the antenna apparatus of FIG. 10, the antenna apparatus is configured in a manner similar to that of the antenna apparatus of FIG. 9, and additionally, the outer perimeter of a looped radiation conductor is shaped such that the distance from a ground conductor G1 gradually increases as proceeding in a direction from a feed point P1 to an inductor L1 (as proceeding to the right). The antenna apparatus of FIG. 10 also provides the same effects as that of the antenna apparatus of FIG. 9.

Second Embodiment

Figure 11:
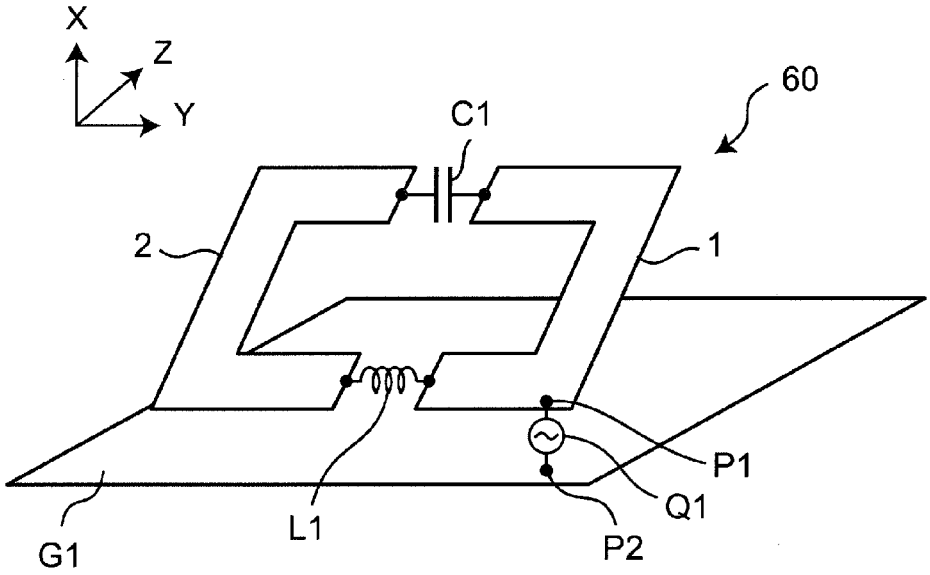
FIG. 11 is a schematic diagram showing an antenna apparatus according to a second embodiment.

FIG. 11 is a schematic diagram showing an antenna apparatus according to a second embodiment. According to the antenna apparatus of FIG. 1, the outer perimeter of a looped radiation conductor is shaped such that in a portion where radiation conductors 1, 2 and a ground conductor G1 are close to each other, the distance from the ground conductor G1 thereto gradually increases as the distance from a feed point P1 along the loop of the radiation conductor increases. However, the embodiment of the present disclosure is not limited to the one in which the distance between the radiation conductors 1, 2 and the ground conductor G1 gradually increases due to the shape of the outer perimeter of the looped radiation conductor. The second embodiment is characterized in that a radiator 60 is positioned with respect to a ground conductor G1 such that the distance from a ground surface of the ground conductor G1 gradually increases as the distance from a feed point P1 along a radiation conductor increases.

Referring to FIG. 11, radiation conductors 1 and 2, a capacitor C1, and an inductor L1 of the radiator 60 are configured in the same manner as that of the radiator 50 of FIG. 2, except that the inductor L1 is closer to the feed point P1 than the capacitor C1. The ground surface of the ground conductor G1 is provided on a first surface (flat or curved surface). The looped radiation conductor is provided on a second surface (flat or curved surface) at least partially opposing to the first surface, and is provided such that the distance from the ground surface of the ground conductor G1 gradually increases as the distance from the feed point P1 along the looped radiation conductor increases. Therefore, according to the antenna apparatus of FIG. 11, the surface including the looped radiation conductor (second surface) has a certain angle with respect to the surface including the ground surface of the ground conductor G1 (first surface).

Figure 12:
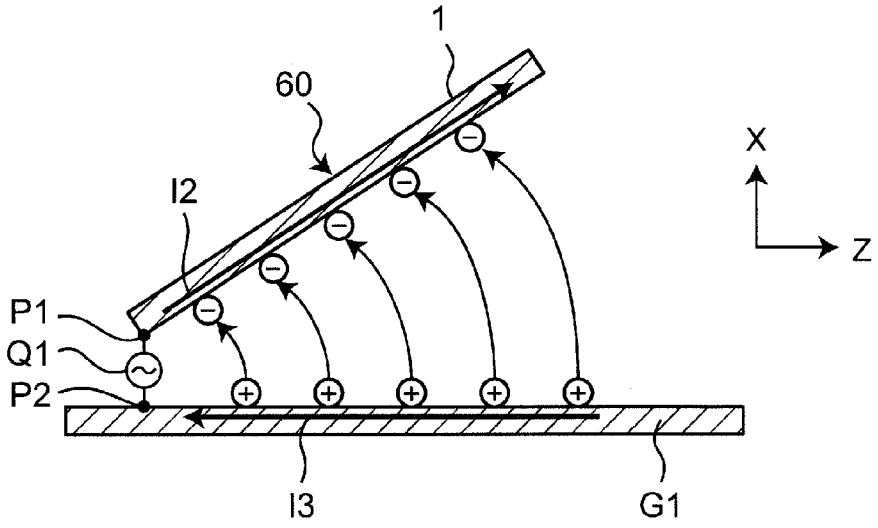
FIG. 12 is a diagram showing a current path for the case where the antenna apparatus of FIG. 11 operates at the high-band resonance frequency f2.

FIG. 12 is a diagram showing a current path for the case where the antenna apparatus of FIG. 11 operates at a high-band resonance frequency f2. When the antenna apparatus operates at the high-band resonance frequency f2, a current I2 flows on the radiator 60 in the same manner as that of FIG. 4, and a current I3 flows through a portion of the ground conductor G1 close to the radiator 60, and flows toward a connecting point P2 (i.e., flows in a direction opposite to that of the current I2). Due to the flowing currents I2 and I3, positive and negative charges are distributed in a portion where the radiation conductor 1 and the radiation conductor 2 (not shown) and the ground conductor G1 are close to each other, as shown in FIG. 12, thus producing electric flux, and forming continuously distributed capacitors. In the portion where the radiation conductors and the ground conductor G1 are close to each other, a resonant circuit is formed from: capacitance distributed between the radiation conductors and the ground conductor G1; and inductance distributed over the radiation conductors. The radiator 60 is configured such that when the antenna apparatus operates at the high-band resonance frequency f2, a portion of the looped radiation conductor through which the current I2 flows, the capacitor C1, and the above-described resonant circuit resonate at the high-band resonance frequency f2.

Since the antenna apparatus of FIG. 11 is also provided with the radiator 60 operable in one of a loop antenna mode and a monopole antenna mode according to the operating frequency, it is possible to effectively achieve dual-band operation, and achieve the size reduction of the antenna apparatus, as described above with respect to the antenna apparatus of FIG. 1. Further, since the looped radiation conductor is provided such that the distance from the ground surface of the ground conductor G1 gradually increases as the distance from the feed point P1 along the looped radiation conductor increases, it is possible to achieve the high frequency operating band, including the high-band resonance frequency f2, with an ultra wide bandwidth.

Figure 13:
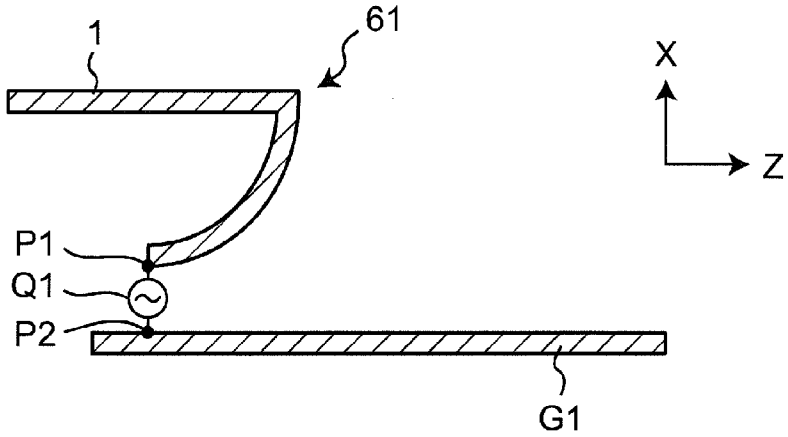
FIG. 13 is a schematic diagram showing an antenna apparatus according to a first modified embodiment of the second embodiment.
Figure 14:
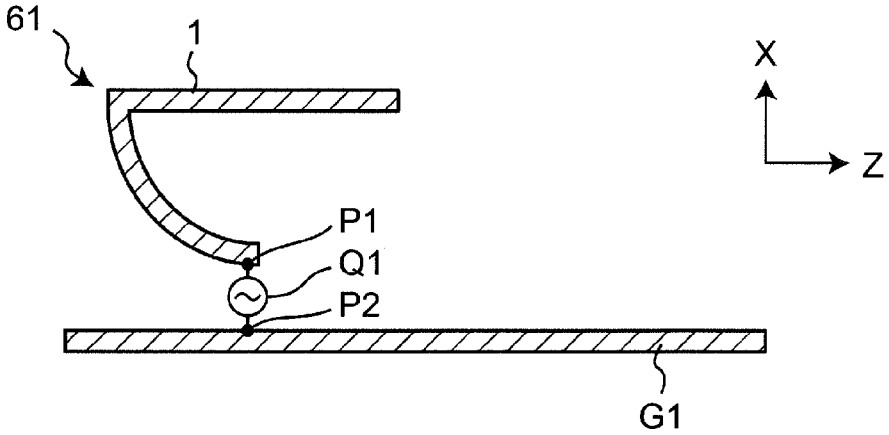
FIG. 14 is a schematic diagram showing an antenna apparatus according to a second modified embodiment of the second embodiment.

FIG. 13 is a schematic diagram showing an antenna apparatus according to a first modified embodiment of the second embodiment. FIG. 14 is a schematic diagram showing an antenna apparatus according to a second modified embodiment of the second embodiment. The looped radiation conductor of the radiator 60 of FIG. 11 may be bent at at least one portion. The antenna apparatus of FIG. 13 is provided with a radiator 61 corresponding to the radiator 60 of FIG. 11, except that the radiation conductors 1 and 2 are bent along a line parallel to the Y-axis, and that portions of the radiation conductors 1 and 2 opposing to the ground surface of the ground conductor G1 are curved. The radiator 61 of FIG. 13 is provided such that its open end is remote from the ground conductor G1. On the other hand, a radiator 61 of FIG. 14 is provided such that its open end is positioned above a ground conductor G1. According to the antenna apparatus of FIG. 13, it is possible to achieve the high frequency operating band, including the high-band resonance frequency f2, with an ultra wide bandwidth, while achieving a low profile antenna apparatus. In addition, according to the antenna apparatus of FIG. 14, even under conditions where the antenna apparatus should be within the area of the ground conductor G1, it is possible to achieve the high frequency operating band, including the high-band resonance frequency f2, with an ultra wide bandwidth, while achieving a low profile antenna apparatus.

Figure 15:
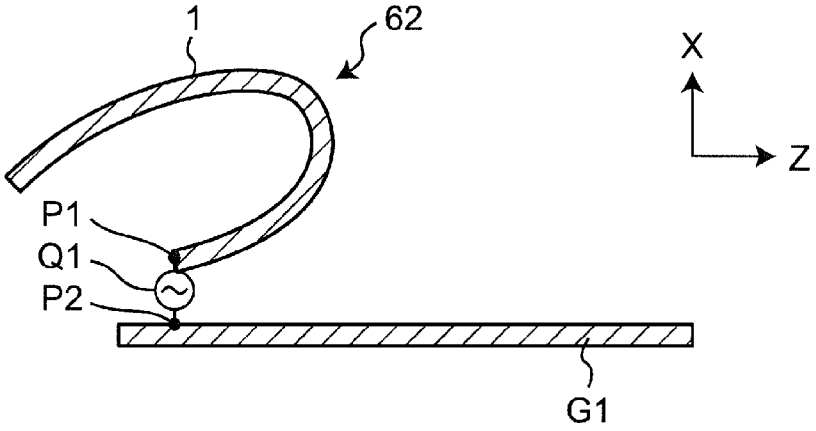
FIG. 15 is a schematic diagram showing an antenna apparatus according to a third modified embodiment of the second embodiment.

FIG. 15 is a schematic diagram showing an antenna apparatus according to a third modified embodiment of the second embodiment. The looped radiation conductor of the radiator 60 of FIG. 11 may be curved at at least one portion. The antenna apparatus of FIG. 15 is provided with a radiator 62 corresponding to the radiator 60 of FIG. 11, except that the looped radiation conductor is curved along a portion around a line parallel to the Y-axis.

According to the antenna apparatuses of FIGS. 13 to 15, the area of a portion where the radiation conductors and the ground surface of the ground conductor G1 are opposed to each other is smaller than that of FIG. 11. It is possible to increase or decrease the number of positions at which the radiation conductors are bent, or the curvature of the radiation conductors, depending on capacitance to be formed between the radiation conductors and the ground surface of the ground conductor G1.

According to the antenna apparatuses of FIGS. 13 to 15, it is possible to reduce the size of the antenna apparatus, depending on the dimensions or shape of a housing of the antenna apparatus (e.g., shapes including curved lines and curved surfaces).

Figure 16:
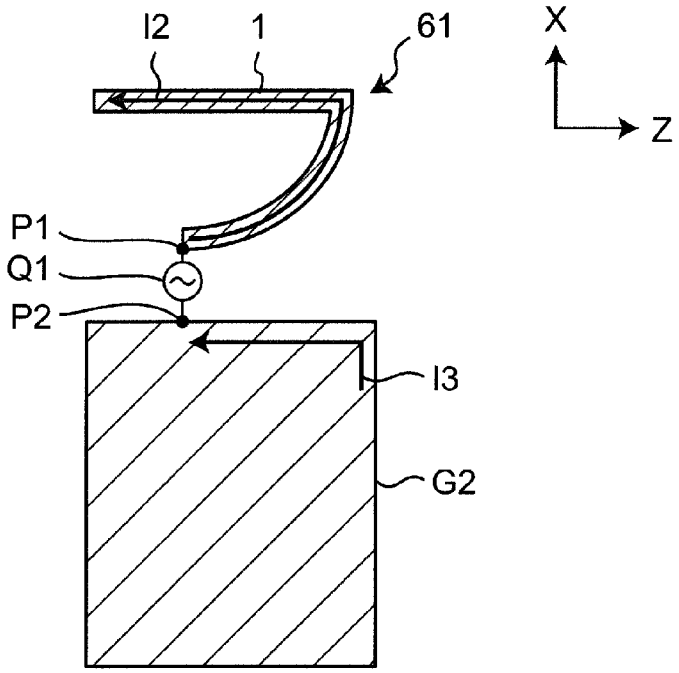
FIG. 16 is a schematic diagram showing an antenna apparatus according to a fourth modified embodiment of the second embodiment.

FIG. 16 is a schematic diagram showing an antenna apparatus according to a fourth modified embodiment of the second embodiment. The antenna apparatus of FIG. 16 shows the case of using, as a ground conductor, a ground conductor G2 made of a conductive block having a certain thickness. A radiator 61 is configured in the same manner as that of FIG. 13. The thickness in the Z direction of the ground conductor G2 is equal to or greater than the length in the Z direction of the radiator 61. FIG. 16 further shows a current path for the case where the antenna apparatus operates at the high-band resonance frequency f2. When the antenna apparatus operates at the high-band resonance frequency f2, a current I2 flows on the radiator 61 in the same manner as that of FIG. 12, and a current 13 flows through a portion of the ground conductor G2 close to the radiator 61, and flows toward a connecting point P2 (i.e., flows in a direction opposite to that of the current I2). In a portion where radiation conductors and the ground conductor G2 are close to each other, a resonant circuit is formed from: capacitance distributed between the radiation conductors and the ground conductor G2; and inductance distributed over the radiation conductors. The radiator 61 is configured such that when the antenna apparatus operates at the high-band resonance frequency f2, a portion of the looped radiation conductor through which the current 12 flows, a capacitor C1, and the above-described resonant circuit resonate at the high-band resonance frequency f2. Since the antenna apparatus of FIG. 16 is also provided with the radiator 61 operable in one of a loop antenna mode and a monopole antenna mode according to the operating frequency, it is possible to effectively achieve dual-band operation, and achieve the size reduction of the antenna apparatus, as described above with respect to the antenna apparatus of FIG. 1. Further, it is possible to achieve the high frequency operating band, including the high-band resonance frequency f2, with an ultra wide bandwidth.

Figure 17:
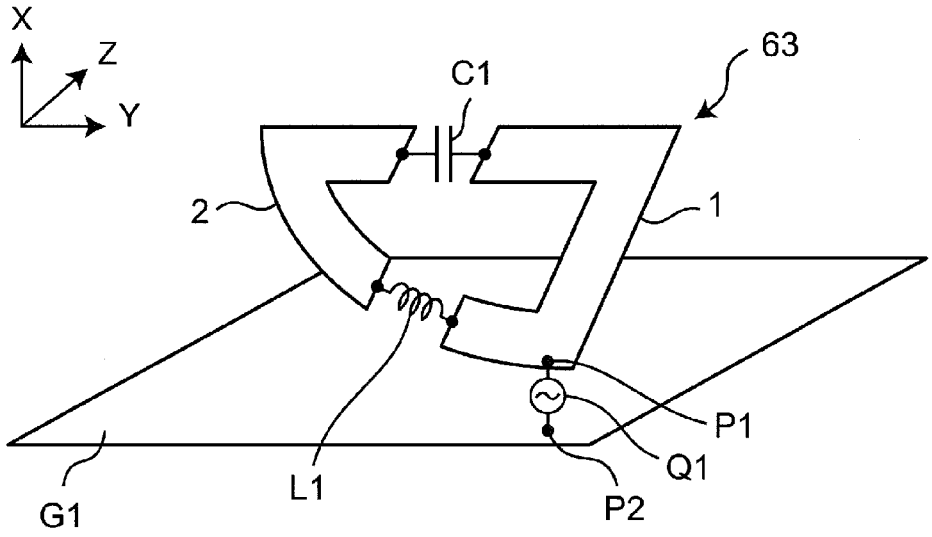
FIG. 17 is a schematic diagram showing an antenna apparatus according to a fifth modified embodiment of the second embodiment.

FIG. 17 is a schematic diagram showing an antenna apparatus according to a fifth modified embodiment of the second embodiment. The antenna apparatus of FIG. 17 is a combination of the first embodiment and the second embodiment. The antenna apparatus of FIG. 17 is provided with a radiator 63, in which a looped radiation conductor is provided such that the distance from a ground surface of a ground conductor G1 gradually increases as the distance from a feed point P1 along the looped radiation conductor increases, in a manner similar to that of the radiator 60 of FIG. 11, and in which the outer perimeter of the looped radiation conductor is shaped such that in a portion where radiation conductors 1, 2 and the ground conductor G1 are close to each other, the distance from the ground conductor G1 thereto gradually increases as the distance from the feed point P1 along the loop of the radiation conductor increases, in a manner similar to that of a radiator 40 of FIG. 1. Therefore, the distance between the radiation conductors 1, 2 and the ground conductor G1 gradually increases as proceeding from the feed point P1 in a first direction (a direction proceeding from the feed point P1 to a capacitor C1) along the looped radiation conductor, and the distance between the radiation conductors 1, 2 and the ground conductor G1 gradually increases as proceeding from the feed point in a second direction opposite to the first direction (a direction proceeding from the feed point P1 to an inductor L1) along the looped radiation conductor. Since the antenna apparatus of FIG. 17 is also provided with the radiator 63 operable in one of a loop antenna mode and a monopole antenna mode according to the operating frequency, it is possible to effectively achieve dual-band operation, and achieve the size reduction of the antenna apparatus, as described above with respect to the antenna apparatuses of FIGS. 1 and 11. Further, it is possible to achieve the high frequency operating band, including the high-band resonance frequency f2, with an ultra wide bandwidth.

Figure 18:
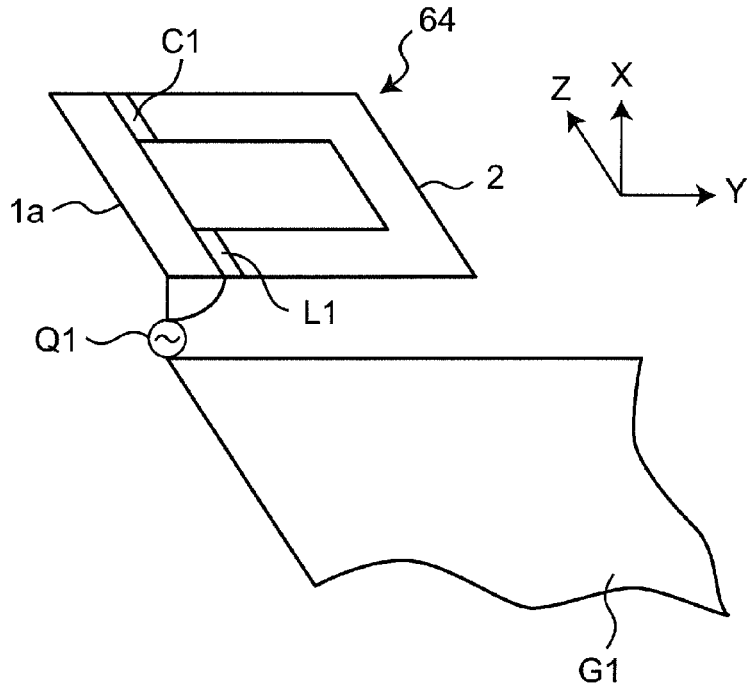
FIG. 18 is a schematic diagram showing an antenna apparatus according to a sixth modified embodiment of the second embodiment.

FIG. 18 is a schematic diagram showing an antenna apparatus according to a sixth modified embodiment of the second embodiment. A ground surface of a ground conductor G1 is provided on a first surface (flat or curved surface). Referring to FIG. 18, the ground surface of the ground conductor G1 is parallel to the YZ-plane. A looped radiation conductor of a radiator 64 is provided on a second surface (flat or curved surface) at a certain distance from the first surface, e.g., on the second surface parallel to the first surface. The ground conductor G1 and the looped radiation conductor are close to and opposed to each other at their edges. Further, a radiation conductor 1*a* has, at its edge close to the ground conductor G1, a portion bent toward the ground surface of the ground conductor G1 (in FIG. 18, a portion parallel to the XY-plane), the portions being bent along a line parallel to the edge. A feed point is provided at the tip of the bent portion (a position closest to the ground surface of the ground conductor G1). In FIGS. 18 to 21, a feed point is represented by a signal source Q1 for ease of illustration. The bent portion of the radiation conductor 1*a* is shaped such that the distance from the ground surface of the ground conductor G1 gradually increases as the distance from the feed point along the looped radiation conductor increases.

Figure 19:
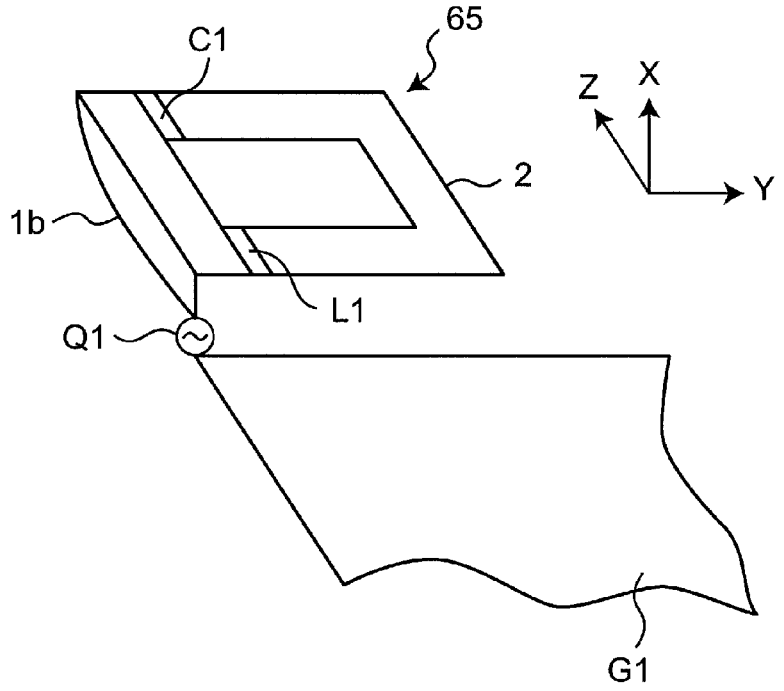
FIG. 19 is a schematic diagram showing an antenna apparatus according to a seventh modified embodiment of the second embodiment.

FIG. 19 is a schematic diagram showing an antenna apparatus according to a seventh modified embodiment of the second embodiment. According to the radiator 64 of FIG. 18, the radiation conductor 1*a* is bent along a line parallel to the edges at which the ground conductor G1 and the looped radiation conductor are close to and opposed to each other. On the other hand, a radiation conductor 1*b* of a radiator 65 of FIG. 19 has a portion bent toward a ground surface of a ground conductor G1, the portion being bent along a line perpendicular to the edges (a line parallel to the Z direction). The bent portion of the radiation conductor 1*b* is shaped such that the distance from the ground surface of the ground conductor G1 gradually increases as the distance from a feed point along a looped radiation conductor increases.

Figure 20:
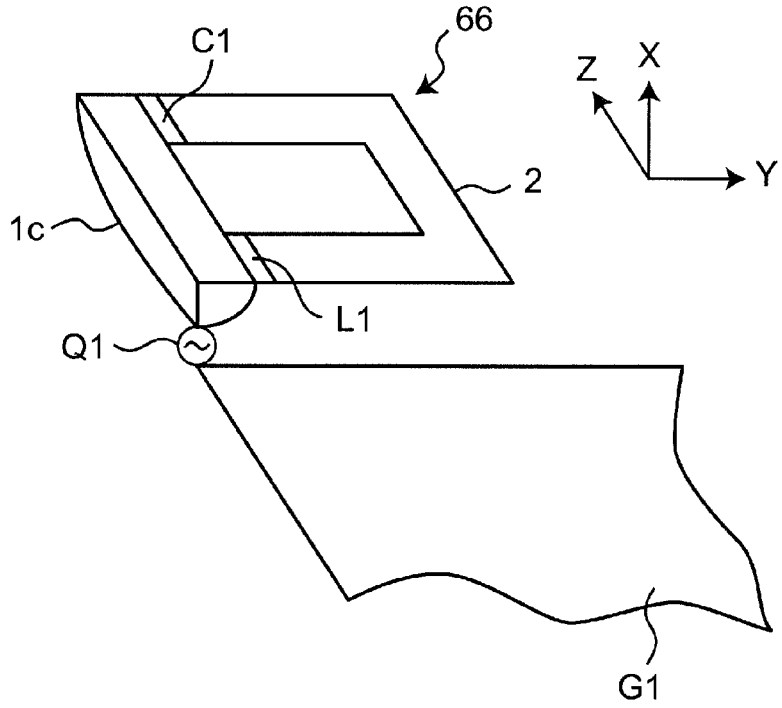
FIG. 20 is a schematic diagram showing an antenna apparatus according to an eighth modified embodiment of the second embodiment.

FIG. 20 is a schematic diagram showing an antenna apparatus according to an eighth modified embodiment of the second embodiment. A radiation conductor 1*c* of a radiator 66 of FIG. 20 is a combination of the radiation conductor 1*a* of FIG. 18 and the radiation conductor 1*b* of FIG. 19. Specifically, the radiation conductor 1*c* has a portion bent along a line parallel to edges at which a ground conductor G1 and a looped radiation conductor are close to and opposed to each other, and has a portion bent along a line perpendicular to the edges. The radiation conductor 1*c* is not limited to the configuration in which a planar conductor is bent, and may be made of a solid conductive block.

Figure 21:
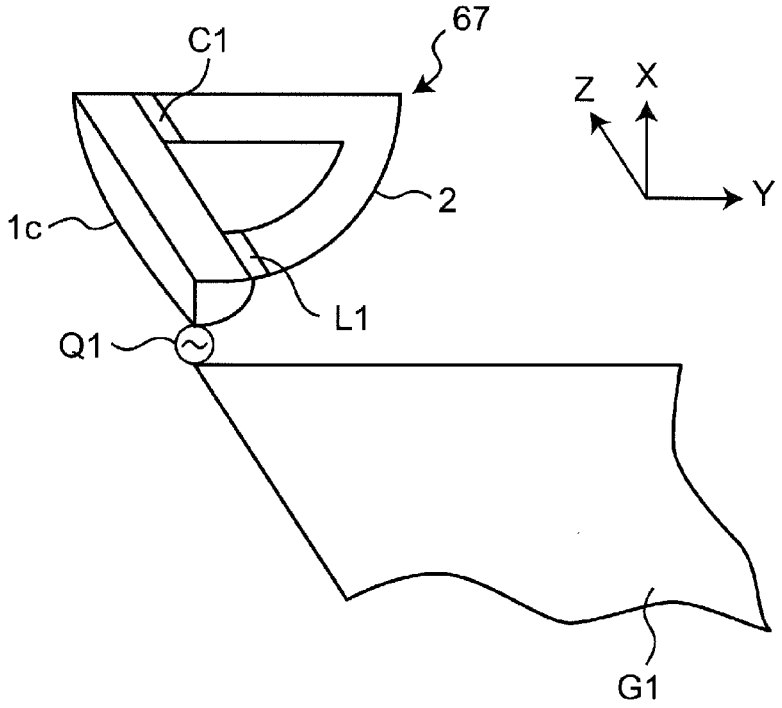
FIG. 21 is a schematic diagram showing an antenna apparatus according to a ninth modified embodiment of the second embodiment.

FIG. 21 is a schematic diagram showing an antenna apparatus according to a ninth modified embodiment of the second embodiment. A radiator 67 of FIG. 21 is a combination of the radiator 40 of FIG. 1 and the radiator 66 of FIG. 20. Specifically, the radiator 67 of FIG. 21 has portions bent in the same manner as that of the radiator 66 of FIG. 20, and in addition, the outer perimeter of a looped radiation conductor is shaped such that in a portion where radiation conductors 1*c*, 2 and a ground conductor G1 are close to each other, the distance from the ground conductor G1 thereto gradually increases as the distance from a feed point along the loop of the radiation conductor increases.

Since the antenna apparatuses of FIGS. 18 to 21 are also provided with the radiators 64 to 67 operable in one of a loop antenna mode and a monopole antenna mode according to the operating frequency, it is possible to effectively achieve dual-band operation, and achieve the size reduction of the antenna apparatus, as described above with respect to the antenna apparatus of FIG. 1. Further, it is possible to achieve the high frequency operating band, including the high-band resonance frequency f2, with an ultra wide bandwidth.

Third Embodiment

Figure 22:
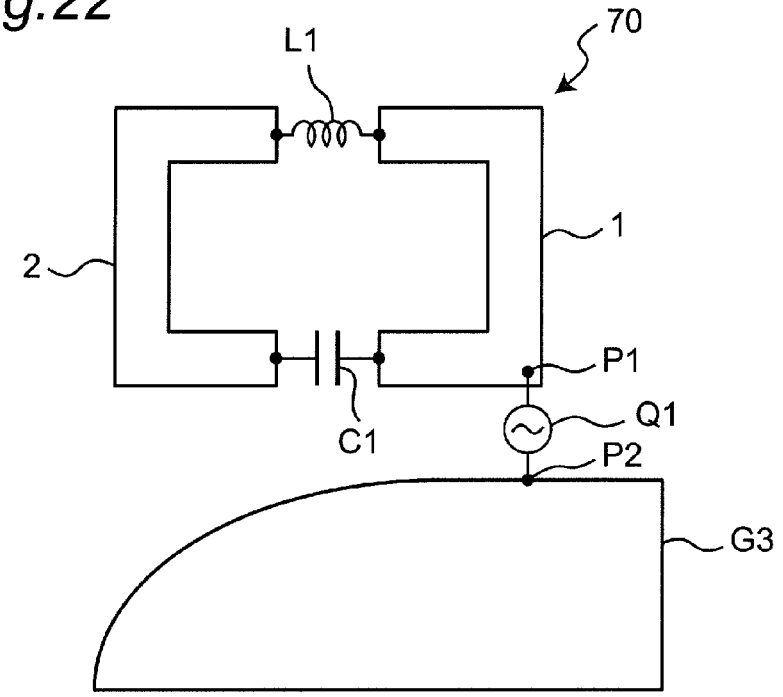
FIG. 22 is a schematic diagram showing an antenna apparatus according to a third embodiment.

FIG. 22 is a schematic diagram showing an antenna apparatus according to a third embodiment. According to the antenna apparatus of FIG. 1, the outer perimeter of a looped radiation conductor is shaped such that in a portion where radiation conductors 1, 2 and a ground conductor G1 are close to each other, the distance from the ground conductor G1 thereto gradually increases as the distance from a feed point P1 along the loop of the radiation conductor increases. However, the embodiment of the present disclosure is not limited to the one in which the distance between the radiation conductors 1, 2 and the ground conductor G1 gradually increases due to the shape of the outer perimeter of the looped radiation conductor, and the distance between the radiation conductors 1, 2 and the ground conductor may gradually increase due to the shape of the outer perimeter of the ground conductor. Referring to FIG. 22, a ground conductor G3 has an edge close to radiation conductors 1 and 2 of a radiator 70, and the edge is shaped such that the distance from the radiation conductors gradually increases as the distance from a feed point P1 along the looped radiation conductor increases.

Figure 23:
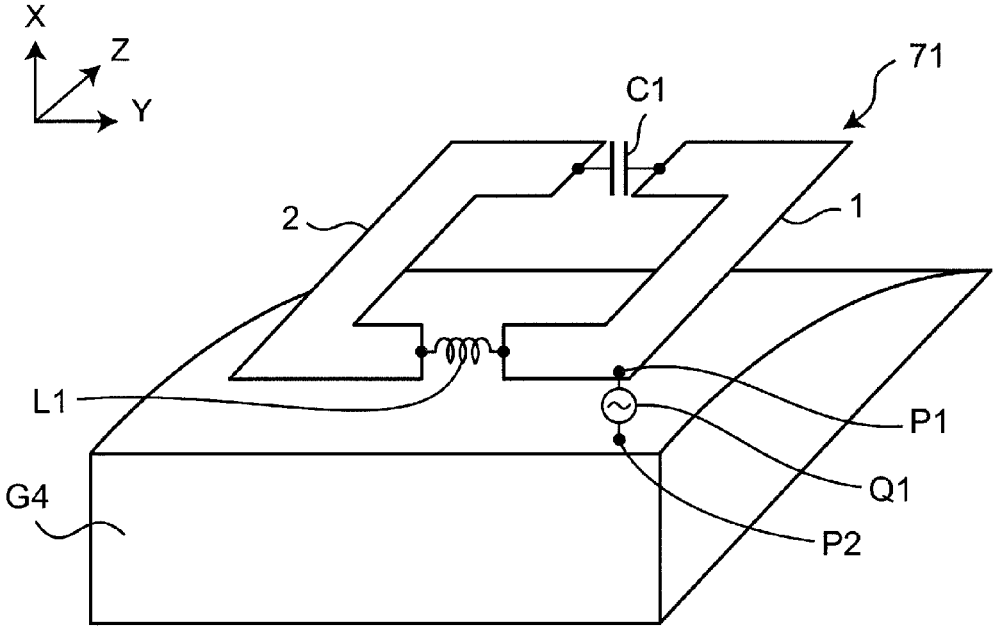
FIG. 23 is a schematic diagram showing an antenna apparatus according to a modified embodiment of the third embodiment.

FIG. 23 is a schematic diagram showing an antenna apparatus according to a modified embodiment of the third embodiment. According to the antenna apparatus of FIG. 11, radiation conductors are provided such that the distance from a ground surface of a ground conductor G1 gradually increases as the distance from a feed point P1 along the looped radiation conductor increases. However, the embodiment of the present disclosure is not limited to the one in which the distance between the radiation conductors 1, 2 and the ground conductor G1 gradually increases due to the position of the radiation conductors with respect to the ground surface of the ground conductor G1, and the distance between the radiation conductors 1, 2 and the ground conductor may gradually increase due to the shape of the ground surface of the ground conductor. Referring to FIG. 23, radiation conductors 1 and 2, a capacitor C1, and an inductor L1 of a radiator 71 are configured in the same manner as that of the radiator 60 of FIG. 11. A ground surface of a ground conductor G4 is provided on a first surface (flat or curved surface). The looped radiation conductor is provided on a second surface (flat or curved surface) at least partially opposed to the first surface. Further, the ground surface of the ground conductor G4 is shaped such that the distance from the radiation conductors gradually increases as the distance from a feed point P1 along the looped radiation conductor increases.

Since the antenna apparatuses of FIGS. 22 and 23 are also provided with the radiators 70 and 71 operable in one of a loop antenna mode and a monopole antenna mode according to the operating frequency, it is possible to effectively achieve dual-band operation, and achieve the size reduction of the antenna apparatus, as described above with respect to the antenna apparatus of the first and second embodiment. Further, it is possible to achieve the high frequency operating band, including the high-band resonance frequency f2, with an ultra wide bandwidth.

Modified Embodiments

Still other modified embodiments of the present disclosure will be described below with reference to FIGS. 24 to 35.

As to a capacitor C1 and an inductor L1, for example, it is possible to use discrete circuit elements, but the capacitor C1 and the inductor L1 are not limited thereto. With reference to FIGS. 24 to 31, modified embodiments of the capacitor C1 and the inductor L1 will be described below.

Figure 24:
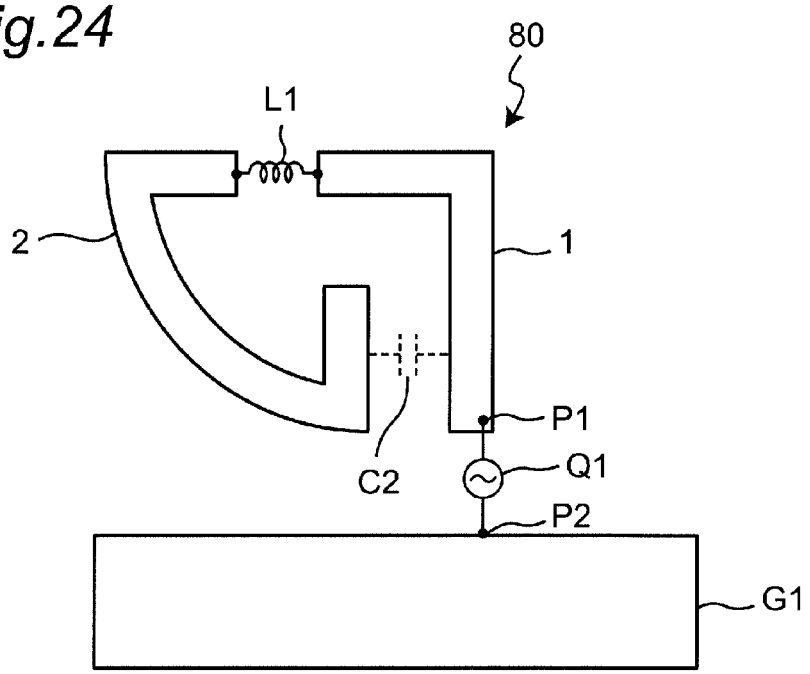
FIG. 24 is a schematic diagram showing an antenna apparatus according to a sixth modified embodiment of the first embodiment.
Figure 25:
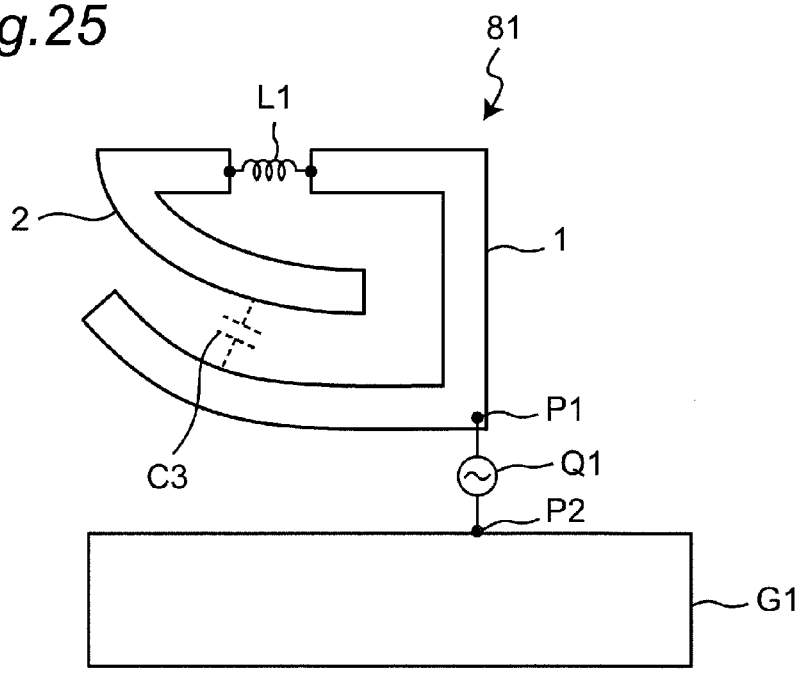
FIG. 25 is a schematic diagram showing an antenna apparatus according to a seventh modified embodiment of the first embodiment.
Figure 26:
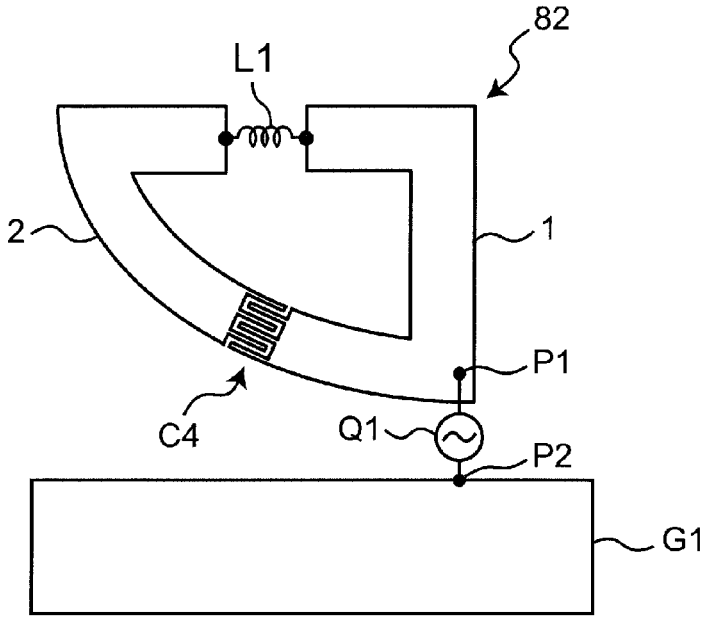
FIG. 26 is a schematic diagram showing an antenna apparatus according to an eighth modified embodiment of the first embodiment.

FIG. 24 is a schematic diagram showing an antenna apparatus according to a sixth modified embodiment of the first embodiment. FIG. 25 is a schematic diagram showing an antenna apparatus according to a seventh modified embodiment of the first embodiment. A radiator 80 of the antenna apparatus of FIG. 24 includes a capacitor C2 formed from portions of radiation conductors 1 and 2 close to each other. A radiator 81 of the antenna apparatus of FIG. 25 includes a capacitor C3 formed from portions of radiation conductors 1 and 2 close to each other. As shown in FIGS. 24 and 25, a virtual capacitor C2, C3 may be formed between the radiation conductors 1 and 2, by arranging the radiation conductors 1 and 2 close to each other to produce a certain capacitance between the radiation conductors 1 and 2. The closer the radiation conductors 1 and 2 approach to each other, or the wider the area where the radiation conductors 1 and 2 are close to each other increases, the more the capacitance of the virtual capacitors C2 and C3 increase. Further, FIG. 26 is a schematic diagram showing an antenna apparatus according to an eighth modified embodiment of the first embodiment. A radiator 82 of the antenna apparatus of FIG. 26 includes a capacitor C4 formed at portions of radiation conductors 1 and 2 close to each other. As shown in FIG. 26, when forming a virtual capacitor C4 by a capacitance between the radiation conductors 1 and 2, an interdigital conductive portion (a configuration in which fingered conductors are engaged with each other) may be formed. The capacitor C4 of FIG. 26 can have an increased capacitance than the capacitors C2 and C3 of FIGS. 24 and 25. A capacitor formed from portions of the radiation conductors 1 and 2 close to each other is not limited to the one formed from a linear conductive portion as shown in FIGS. 24 and 25, or an interdigital conductive portion as shown in FIG. 26, and may be formed from conductive portions of other shapes. For example, the distance between the radiation conductors 1 and 2 of the antenna apparatus of FIG. 24 may be changed according to their positions, such that the capacitance between the radiation conductors 1 and 2 varies depending on the positions on the radiation conductors 1 and 2.

Figure 27:
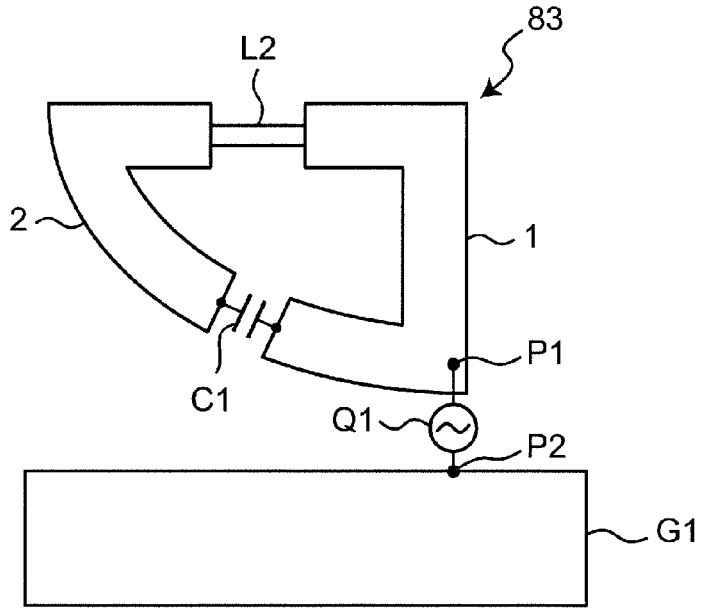
FIG. 27 is a schematic diagram showing an antenna apparatus according to a ninth modified embodiment of the first embodiment.
Figure 28:
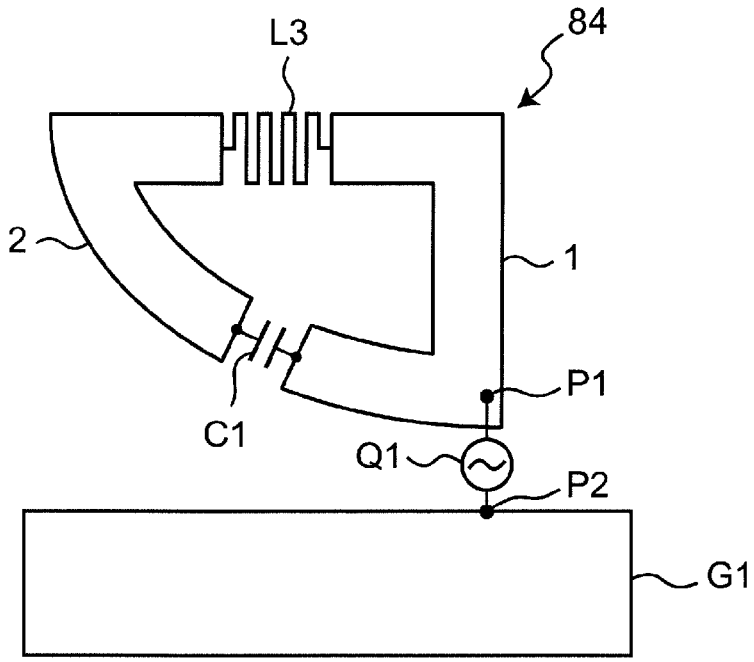
FIG. 28 is a schematic diagram showing an antenna apparatus according to a tenth modified embodiment of the first embodiment.

FIG. 27 is a schematic diagram showing an antenna apparatus according to a ninth modified embodiment of the firth embodiment. A radiator 83 of the antenna apparatus of FIG. 27 includes an inductor L2 formed as a strip conductor. FIG. 28 is a schematic diagram showing an antenna apparatus according to a tenth modified embodiment of the first embodiment. A radiator 84 of the antenna apparatus of FIG. 28 includes an inductor L3 formed as a meander conductor. The thinner the widths of conductors forming the inductors L2 and L3 are, and the longer the lengths of the conductors are, the more the inductances of the inductors L2 and L3 increase.

The capacitors C2 to C4 and the inductors L2 and L3 shown in FIGS. 24 to 28 may be combined with each other. For example, a radiator may be configured to include the capacitor C2 of FIG. 24 and the inductor L2 of FIG. 27, instead of the capacitor C1 and the inductor L1 of FIG. 1.

Figure 29:
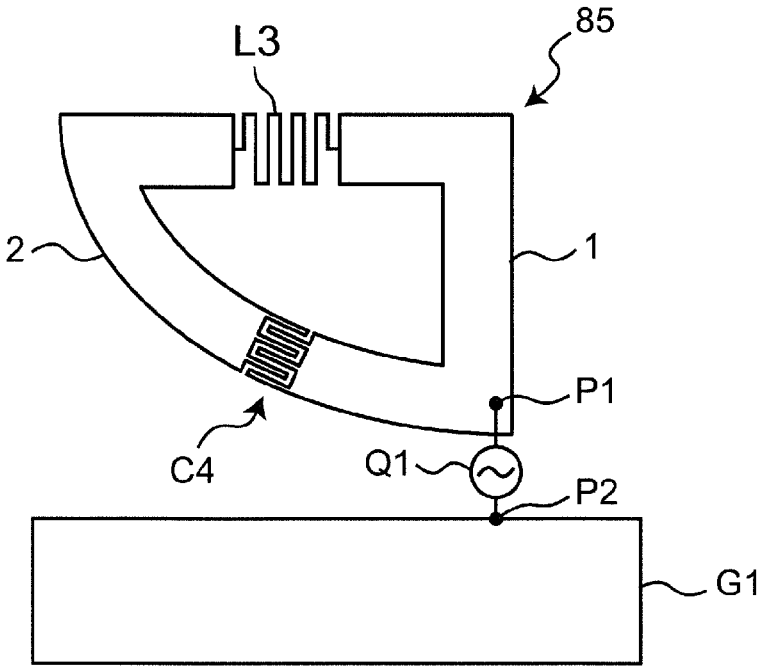
FIG. 29 is a schematic diagram showing an antenna apparatus according to an eleventh modified embodiment of the first embodiment.

FIG. 29 is a schematic diagram showing an antenna apparatus according to an eleventh modified embodiment of the first embodiment. A radiator 85 of the antenna apparatus of FIG. 29 includes a capacitor C4 formed at portions of radiation conductors 1 and 2 close to each other, and an inductor L3 formed as a meander conductor. According to the antenna apparatus of FIG. 29, since both the capacitor and the inductor can be formed as conductive patterns on a dielectric substrate, there are advantageous effects such as cost reduction and reduction in manufacturing variations.

Figure 30:
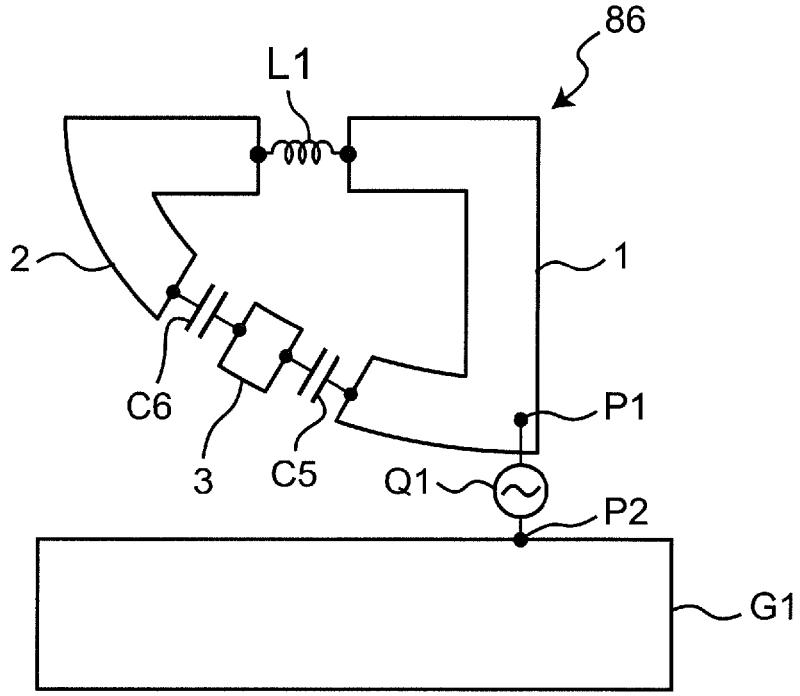
FIG. 30 is a schematic diagram showing an antenna apparatus according to a twelfth modified embodiment of the first embodiment.
Figure 31:
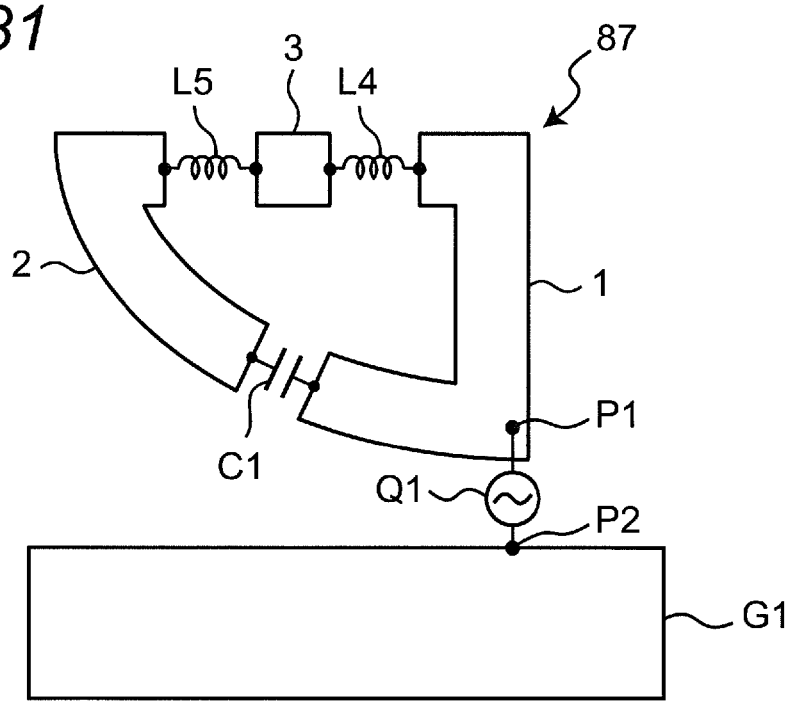
FIG. 31 is a schematic diagram showing an antenna apparatus according to a thirteenth modified embodiment of the first embodiment.

FIG. 30 is a schematic diagram showing an antenna apparatus according to a twelfth modified embodiment of the first embodiment. A radiator 86 of the antenna apparatus of FIG. 30 includes a plurality of capacitors C5 and C6. An antenna apparatus of the present embodiment is not limited to the one provided with a single capacitor and a single inductor, and may be provided with concatenated capacitors, including two or more capacitors, and/or provided with concatenated inductors, including two or more inductors. Referring to FIG. 30, the capacitors C5 and C6 connected to each other by a third radiation conductor 3 having a certain electrical length are inserted, instead of the capacitor C1 of FIG. 1. In other words, the capacitors C5 and C6 are inserted at different positions along a looped radiation conductor. Also in the case of including a plurality of inductors, the antenna apparatus is configured in a manner similar to that of the modified embodiment shown in FIG. 30. FIG. 31 is a schematic diagram showing an antenna apparatus according to a thirteenth modified embodiment of the first embodiment. A radiator 87 of the antenna apparatus of FIG. 31 includes a plurality of inductors L4 and L5. Referring to FIG. 31, the inductors L4 and L5 connected to each other by a third radiation conductor 3 having a certain electrical length are inserted, instead of the inductor L1 of FIG. 1. In other words, the inductors L4 and L5 are inserted at different positions along a looped radiation conductor. In a manner similar to that of the antenna apparatuses of FIGS. 30 and 31, a plurality of capacitors and a plurality of inductors may be inserted at different positions along the looped radiation conductor. According to the antenna apparatuses of FIGS. 30 and 31, since capacitors and inductors can be inserted at three or more different positions in consideration of the current distribution on the radiator, there is an advantageous effect that when designing the antenna apparatus, it is possible to easily achieve fine adjustments of the low-band resonance frequency f1 and the high-band resonance frequency f2.

Figure 32:
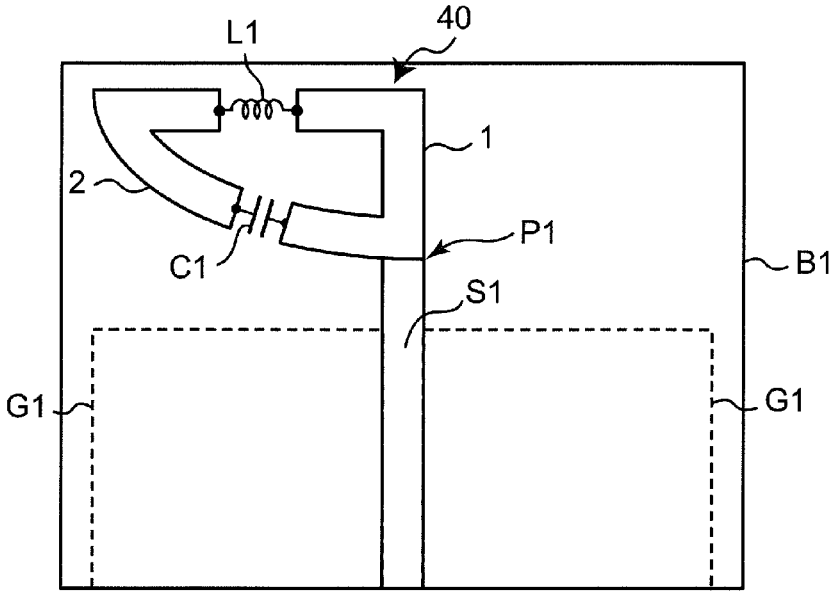
FIG. 32 is a schematic diagram showing an antenna apparatus according to a fourteenth modified embodiment of the first embodiment.

FIG. 32 is a schematic diagram showing an antenna apparatus according to a fourteenth modified embodiment of the first embodiment. FIG. 32 shows an antenna apparatus provided with a feed line as a microstrip line. The antenna apparatus of the present modified embodiment is provided with a feed line as a microstrip line, including a ground conductor G1, and a strip conductor S1 provided on the ground conductor G1 with a dielectric substrate B1 therebetween. The antenna apparatus of the present modified embodiment may have a planar configuration for reducing the profile of the antenna apparatus, in other words, the ground conductor G1 may be formed on the back side of a printed circuit board, and the strip conductor S1 and a radiator 40 may be integrally formed on the front side of the printed circuit board. The feed line is not limited to a microstrip line, and may be a coplanar line, a coaxial line, etc.

Figure 33:
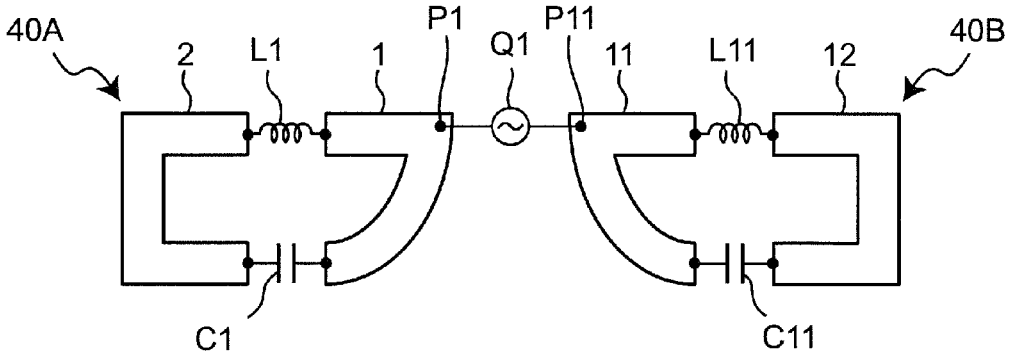
FIG. 33 is a schematic diagram showing an antenna apparatus according to a fifteenth modified embodiment of the first embodiment.

FIG. 33 is a schematic diagram showing an antenna apparatus according to a fifteenth modified embodiment of the first embodiment. FIG. 33 shows an antenna apparatus configured as a dipole antenna provided with a first radiator 40A corresponding to the radiator 40 of FIG. 1, and a second radiator 40B instead of the ground conductor of FIG. 1. The left radiator 40A of FIG. 33 is configured in the same manner as that of the radiator 40 of FIG. 1. The right radiator 40B of FIG. 33 is also configured in the same manner as that of the radiator 40 of FIG. 1, and the radiator 40B is provided with a first radiation conductor 11, a second radiation conductor 12, a capacitor C11, and an inductor L11. The radiators 40A and 40B are provided adjacent to each other so as to have portions close to and electromagnetically coupled to each other. A feed point P1 of the radiator 40A and a feed point P11 of the radiator 40B are provided close to each other. A signal source Q1 is connected to the feed point P1 of the radiator 40A and to the feed point P11 of the radiator 40B, respectively. In a portion where the radiation conductors of the radiators 40A and 40B are close to each other, a distance between the radiation conductors of the radiators 40A and 40B gradually increases as distances from the feed points P1 and P11 along the looped radiation conductors increase. The antenna apparatus of the present modified embodiment has a dipole configuration, and accordingly, is operable in a balance mode, thus suppressing unwanted radiation.

Figure 34:
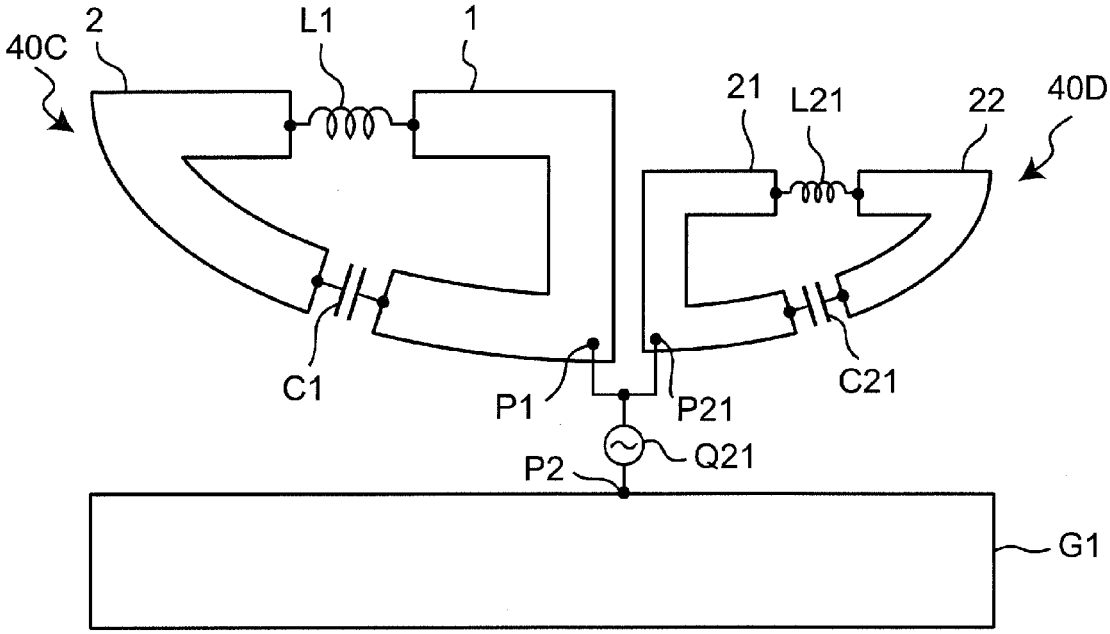
FIG. 34 is a schematic diagram showing an antenna apparatus according to a sixteenth modified embodiment of the first embodiment.

FIG. 34 is a schematic diagram showing an antenna apparatus according to a sixteenth modified embodiment of the first embodiment. FIG. 34 shows a multiband antenna apparatus operable in four bands. A left radiator 40C of FIG. 34 is configured in the similar manner as that of the radiator 40 of FIG. 1. A right radiator 40D of FIG. 34 is also configured in the similar manner as that of the radiator 40 of FIG. 1, and the radiator 40D is provided with a first radiation conductor 21, a second radiation conductor 22, a capacitor C21, and an inductor L21. However, an electrical length of a loop formed from the radiation conductors 21 and 22, the capacitor C21, and the inductor L21 of the radiator 40D is different from an electrical length of a loop formed from radiation conductors 1 and 2, a capacitor C1, and an inductor L1 of the radiator 40C. A signal source Q21 is connected to a feed point P1 on the radiation conductor 1, a feed point P21 on the radiation conductor 21, and a connecting point P2 on a ground conductor G1. The signal source Q21 generates a radio frequency signal of the low-band resonance frequency f1 and a radio frequency signal of the high-band resonance frequency f2, and generates a radio frequency signal of another low-band resonance frequency f21 different from the low-band resonance frequency f1, and a radio frequency signal of another high-band resonance frequency f22 different from the high-band resonance frequency f2. The radiator 40C operates in a loop antenna mode at the low-band resonance frequency f1, and operates in a monopole antenna mode at the high-band resonance frequency f2. On the other hand, the radiator 40D operates in a loop antenna mode at the low-band resonance frequency f21, and operates in a monopole antenna mode at the high-band resonance frequency f22. Thus, the antenna apparatus of the present modified embodiment is capable of multiband operation in four bands. The antenna apparatus of the present modified embodiment can achieve further multiband operation by further providing a radiator.

Figure 35:
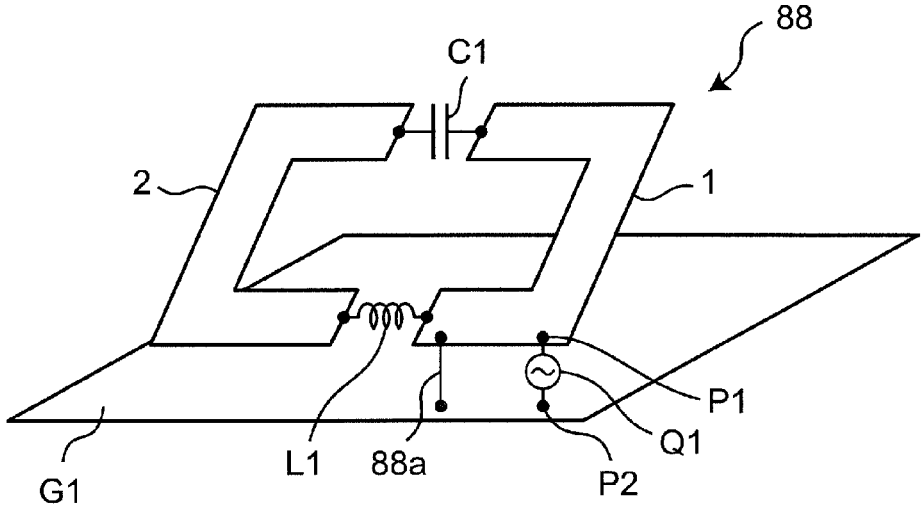
FIG. 35 is a schematic diagram showing an antenna apparatus according to a tenth modified embodiment of the second embodiment.

FIG. 35 is a schematic diagram showing an antenna apparatus according to a tenth modified embodiment of the second embodiment. The antenna apparatus of FIG. 35 is configured in a mariner similar to that of the antenna apparatus of FIG. 11, and additionally, is characterized by a short-circuit conductor 88*a* connecting a radiation conductor 1 of a radiator 88 to a ground conductor G1, and thus, the antenna apparatus is configured as an inverted-F antenna apparatus. The short-circuit conductor 88*a* can be connected to any position on the radiation conductor 1 (i.e., the radiation conductor having a feed point P1). Short-circuiting a part of the radiator to the ground conductor results in an increased radiation resistance, and it does not impair the basic operating principle of the antenna apparatus according to the present embodiment. The short-circuit conductor 88*a* can be applied not only to the antenna apparatus of FIG. 11, but also to the antenna apparatuses of other embodiments and the modified embodiments.

Fourth Embodiment

Figure 36:
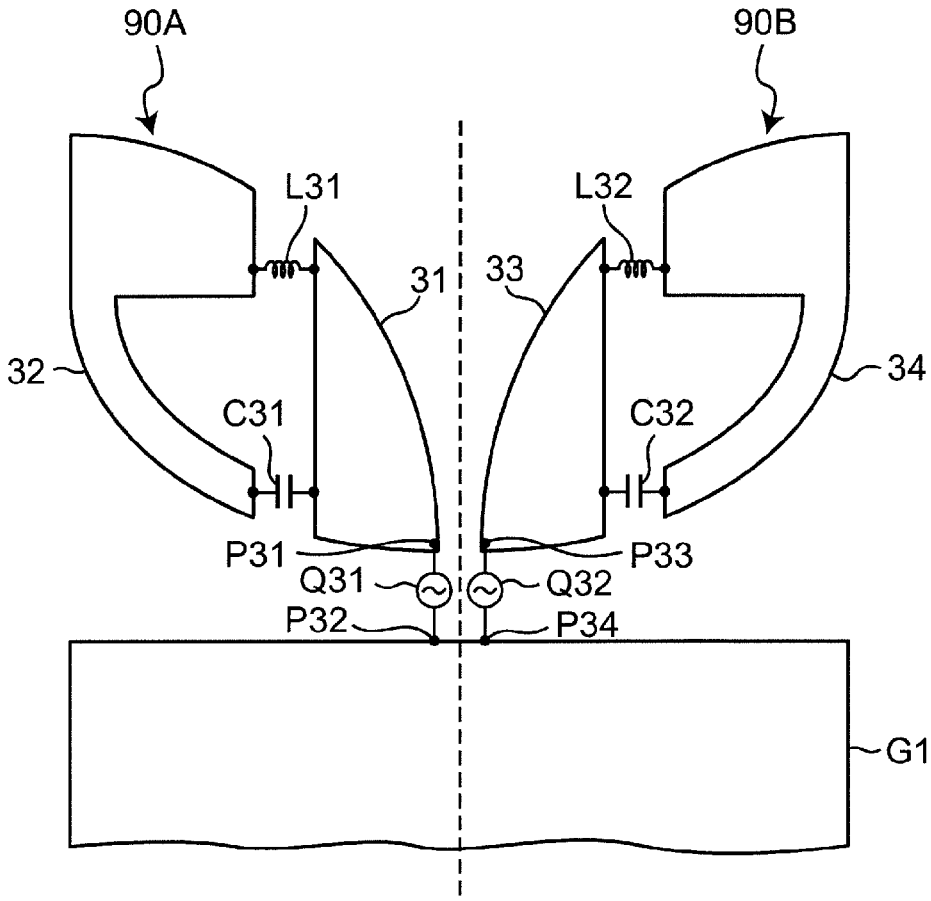
FIG. 36 is a schematic diagram showing an antenna apparatus according to a fourth embodiment.

FIG. 36 is a schematic diagram showing an antenna apparatus according to a fourth embodiment. The antenna apparatus of the present embodiment is characterized in that the antenna apparatus includes two radiators 90A and 90B configured according to the same principle as that for a radiator 40 of FIG. 1, and the radiators 90A and 90B are independently excited by different signal sources Q31 and Q32.

Referring to FIG. 36, the radiator 90A is provided with: a first radiation conductor 31 having a certain electrical length; a second radiation conductor 32 having a certain electrical length; a capacitor C31 connecting the radiation conductors 31 and 32 to each other at a certain position; and an inductor L31 connecting the radiation conductors 31 and 32 to each other at a position different from that of the capacitor C31. In the radiator 90A, the radiation conductors 31 and 32, the capacitor C31, and the inductor L31 form a loop surrounding a central portion. In other words, the capacitor C31 is inserted at a position along the looped radiation conductor, and the inductor L31 is inserted at another position along the looped radiation conductor different from the position where the capacitor C31 is inserted. The signal source Q31 is connected to a feed point P31 on the radiation conductor 31, and is connected to a connecting point P32 on a ground conductor G1 provided close to the radiator 90A. In the antenna apparatus of FIG. 36, the capacitor C31 is provided closer to the feed point P31 than the inductor L31. The radiator 90B is configured in the similar manner as that of the radiator 90A, and is provided with a first radiation conductor 33, a second radiation conductor 34, a capacitor C32, and an inductor L32. In the radiator 90B, the radiation conductors 33 and 34, the capacitor C32, and the inductor L32 form a loop surrounding a central portion. The signal source Q32 is connected to a feed point P33 on the radiation conductor 33, and is connected to a connecting point P34 on the ground conductor G1 provided close to the radiator 90B. In the antenna apparatus of FIG. 36, the capacitor C32 is provided closer to the feed point P33 than the inductor L32. The signal sources Q31 and Q32 generate, for example, radio frequency signals as transmitting signals of MIMO communication scheme, and generate radio frequency signals of the same low-band resonance frequency f1, and generate radio frequency signals of the same high-band resonance frequency f2.

The looped radiation conductors of the radiators 90A and 90B are formed, for example, to be symmetrical with respect to a reference axis (a vertical dashed line in FIG. 36). The radiation conductors 31 and 33 and feed portions (the feed points P31 and P33 and the connecting points P32 and P34) are provided close to the reference axis, and the radiation conductors 32 and 34 are provided remote from the reference axis. The feed points P31 and P33 are provided at positions symmetrical with respect to the reference axis. It is possible to reduce the electromagnetic coupling between the radiators 90A and 90B by shaping radiators 90A and 90B such that a distance between the radiators 90A and 90B gradually increases as a distance from the feed points P31 and P33 along the reference axis increases. Further, since the distance between the two feed points P31 and P33 is small, it is possible to minimize an area for placing traces of feed lines from a wireless communication circuit (not shown).

Figure 37:
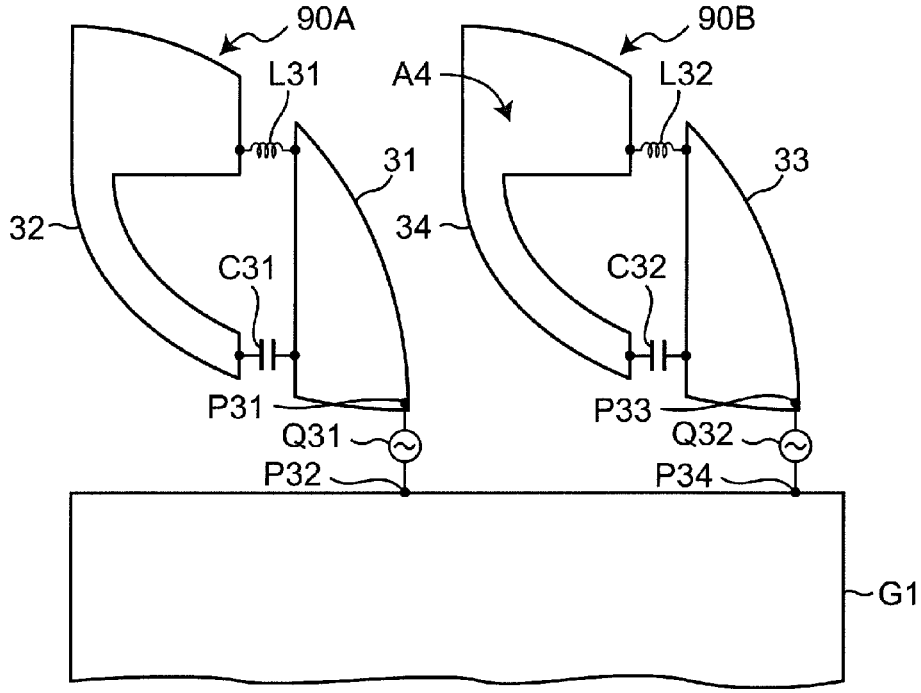
FIG. 37 is a schematic diagram showing an antenna apparatus according to a first modified embodiment of the fourth embodiment.

FIG. 37 is a schematic diagram showing an antenna apparatus according to a first modified embodiment of the fourth embodiment. In the antenna apparatus of the present modified embodiment, radiators 90A and 90B are not disposed symmetrically, but disposed in the same direction (i.e., asymmetrically). Asymmetric disposition of the radiators 90A and 90B results in their asymmetric radiation patterns, thus providing the advantageous effect of reduced correlation between signals transmitted or received through the radiators 90A and 90B. However, since a difference occurs between powers of transmitting signals and powers of received signals, it is not possible to maximize the transmitting or receiving performance for a MIMO communication scheme. Further, three or more radiators may be disposed in a manner similar to that of the antenna apparatus of this modified embodiment.

Figure 38:
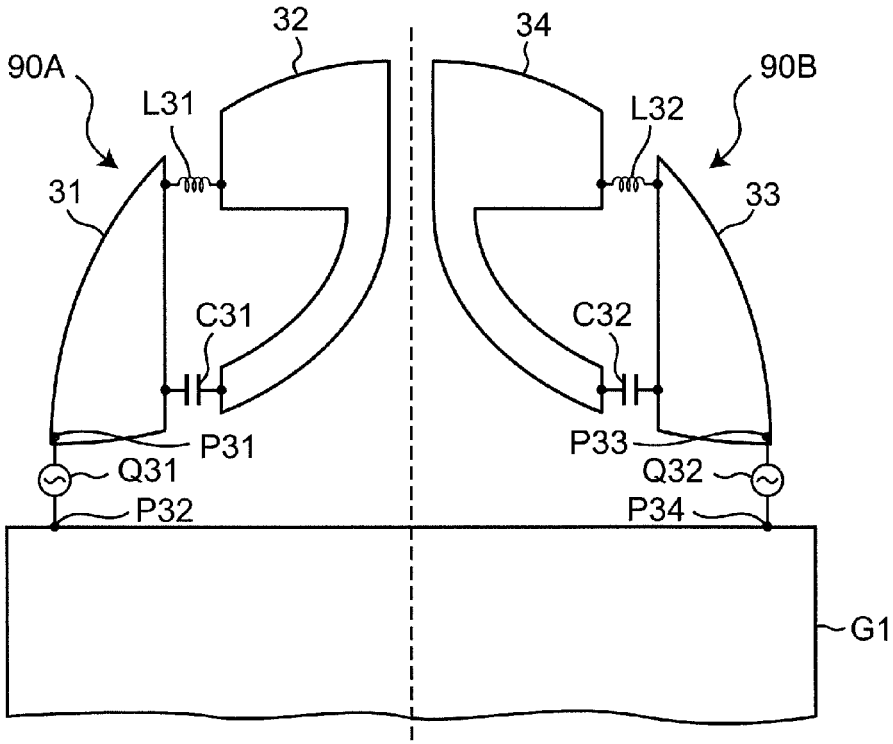
FIG. 38 is a schematic diagram showing an antenna apparatus according to a comparison example of the fourth embodiment.

FIG. 38 is a schematic diagram showing an antenna apparatus according to a comparison example of the fourth embodiment. In the antenna apparatus of FIG. 38, radiation conductors 32 and 34 not having a feed point are disposed close to each other. By separating feed points P31 and P33 from each other, it is possible to reduce the correlation between signals transmitted or received through radiators 90A and 90B. However, since the open ends of the respective radiators 90A and 90B (i.e., the edges of the radiation conductors 32 and 34) are opposed to each other, the electromagnetic coupling between the radiators 90A and 90B is large.

Figure 39:
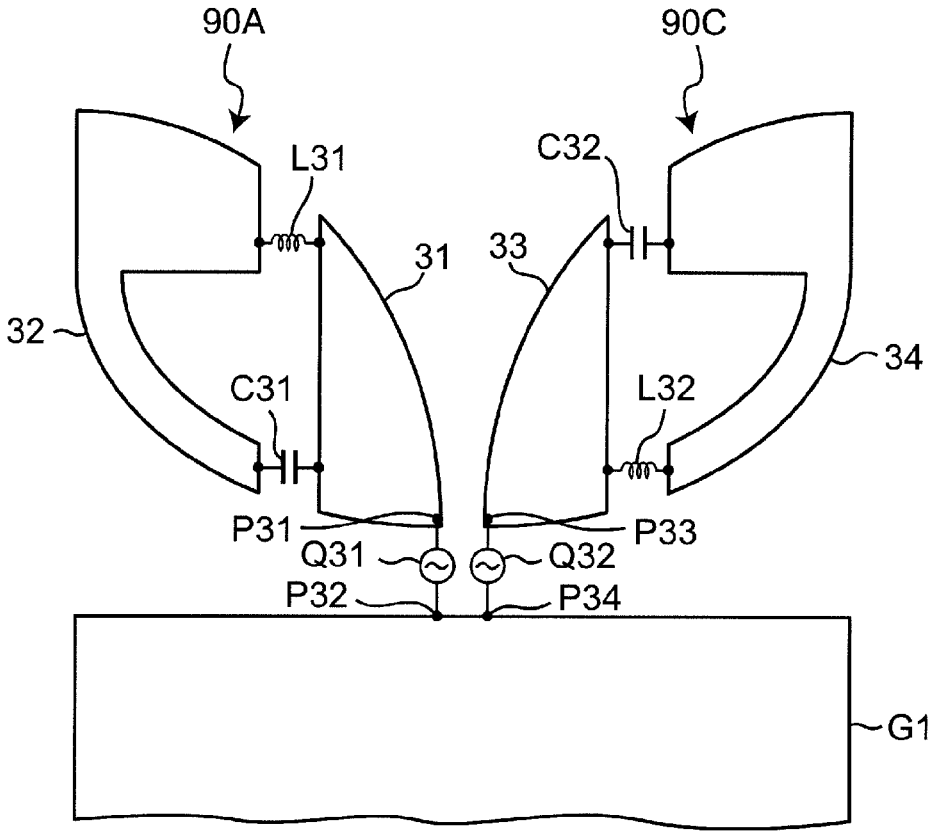
FIG. 39 is a schematic diagram showing an antenna apparatus according to a second modified embodiment of the fourth embodiment.

FIG. 39 is a schematic diagram showing an antenna apparatus according to a second modified embodiment of the fourth embodiment. The antenna apparatus of the present modified embodiment is characterized by a radiator 90C, instead of the radiator 90B of FIG. 36, and the radiator 90C is configured such that the positions of a capacitor C32 and an inductor L32 are asymmetrical with respect to the positions of a capacitor C31 and an inductor L31 of a radiator 90A, in order to reduce electromagnetic coupling between the two radiators for the case where the antenna apparatus operates at the low-band resonance frequency f1.

For comparison, at first, the case is considered in which when the antenna apparatus of FIG. 36 operates at the low-band resonance frequency f1, for example, only one signal source Q31 operates. When the radiator 90A operates in a loop antenna mode due to a current inputted from the signal source Q31, a magnetic field produced by the radiator 90A induces a current in the radiator 90B of FIG. 36, the current flowing in the same direction as a current on the radiator 90A, and flowing to the signal source Q32. Since the large induced current flows through the radiator 90B, large electromagnetic coupling between the radiators 90A and 90B occurs. On the other hand, when the antenna apparatus of FIG. 36 operates at the high-band resonance frequency f2, in the radiator 90A, a current inputted from the signal source Q31 flows in a direction remote from the radiator 90B. Therefore, electromagnetic coupling between the radiators 90A and 90B is small, and an induced current flowing through the radiator 90B and the signal source Q32 is also small.

Referring again to the antenna apparatus of the present modified embodiment of FIG. 39, when proceeding along the symmetric loops of the radiation conductors of the radiators 90A and 90C in corresponding directions starting from respective feed points P31 and P33 (e.g., when proceeding counterclockwise in the radiator 90A and proceeding clockwise in the radiator 90C), the radiator 90A is configured such that the feed point P31, the inductor L31, and the capacitor C31 are located in this order, and the radiator 90C is configured such that the feed point P33, the capacitor C32, and the inductor L32 are located in this order. In addition, while the radiator 90A is configured such that the capacitor C31 is provided closer to the feed point P31 than the inductor L31, the radiator 90C is configured such that the inductor L32 is provided closer to the feed point P33 than the capacitor C32. Thus, the capacitors and the inductors are asymmetrically arranged between the radiators 90A and 90C, electromagnetic coupling between the radiators 90A and 90C is reduced.

As described above, by nature, a current having a low frequency component can pass through an inductor, but is difficult to pass through a capacitor. Therefore, when the antenna apparatus of FIG. 39 operates at the low-band resonance frequency f1, even if the radiator 90A operates in a loop antenna mode due to a current inputted from a signal source Q31, an induced current on the radiator 90C is small, and a current flowing from the radiator 90C to a signal source Q32 is also small. Thus, electromagnetic coupling between the radiators 90A and 90C for the case where the antenna apparatus of FIG. 39 operates at the low-band resonance frequency f1 is small. When the antenna apparatus of FIG. 39 operates at the high-band resonance frequency f2, electromagnetic coupling between the radiators 90A and 90C is small.

In order to reduce the size of the antenna apparatus, any of the radiation conductors 31 to 34 may be bent at at least one position. In addition, when the antenna apparatus operates at the high-band resonance frequency f2, a current may flow to the tip (top end) of the radiation conductor 32 or to a certain position on the radiation conductor 32, e.g., a position at which the radiation conductor is bent, depending on the frequency, instead of flowing to the position of the inductor L31.

Fifth Embodiment

Figure 54:
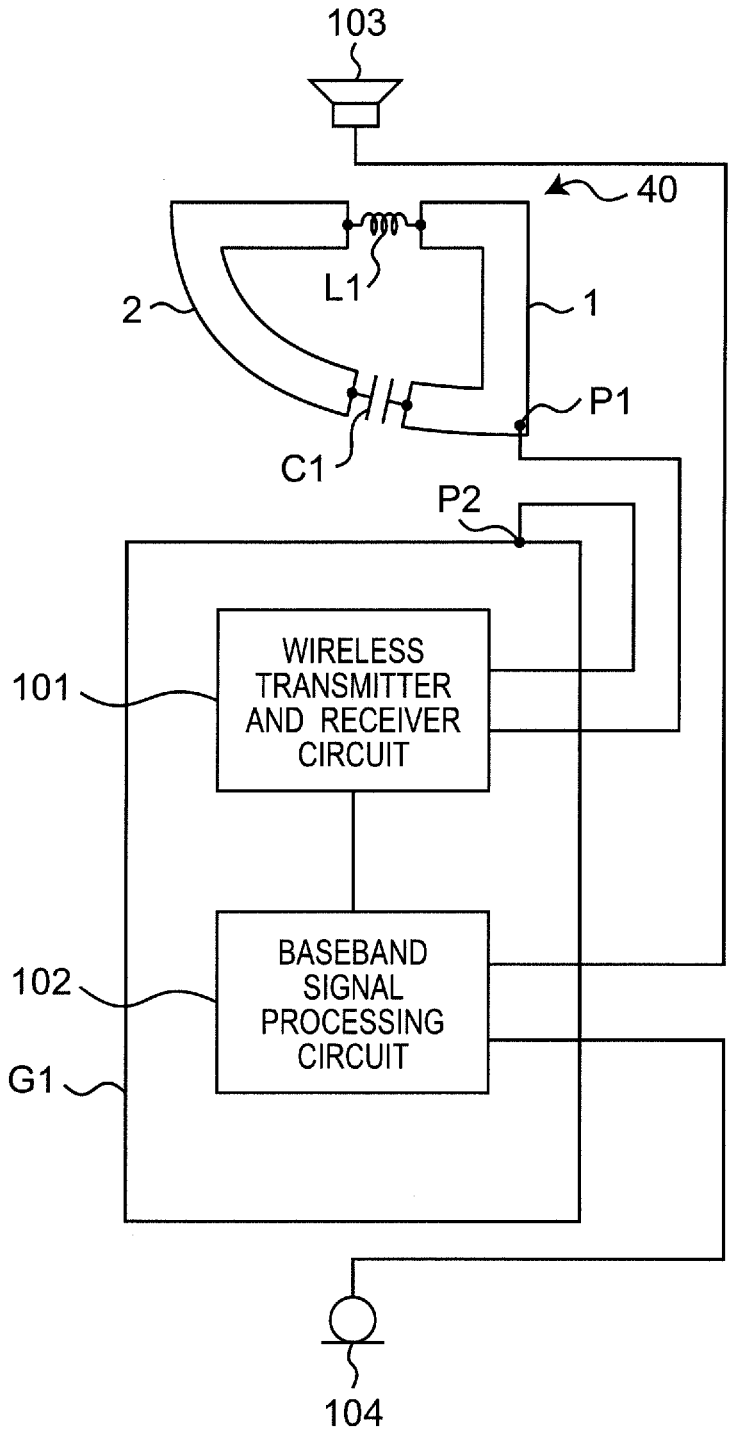
FIG. 54 is a block diagram showing a configuration of a wireless communication apparatus according to a fifth embodiment, provided with the antenna apparatus of FIG. 1.

FIG. 54 is a block diagram showing a configuration of a wireless communication apparatus according to a fifth embodiment, provided with an antenna apparatus of FIG. 1. A wireless communication apparatus according to the present embodiment may be configured as, for example, a mobile phone as shown in FIG. 54. The wireless communication apparatus of FIG. 54 is provided with an antenna apparatus of FIG. 1, a wireless transmitter and receiver circuit 101, a baseband signal processing circuit 102 connected to the wireless transmitter and receiver circuit 101, and a speaker 103 and a microphone 104 which are connected to the baseband signal processing circuit 102. A feed point P1 of a radiator 40 and a connecting point P2 of a ground conductor G1 of the antenna apparatus are connected to the wireless transmitter and receiver circuit 101, instead of a signal source Q1 of FIG. 1. When a wireless broadband router apparatus, a high-speed wireless communication apparatus for M2M (Machine-to-Machine), or the like, is implemented as the wireless communication apparatus, it is not necessary to have a speaker, a microphone, etc., and alternatively, an LED (Light-Emitting Diode), etc., may be used to check the communication status of the wireless communication apparatus. Wireless communication apparatuses to which the antenna apparatuses of FIG. 1, etc., are applicable are not limited to those exemplified above.

Since the wireless communication apparatus of the present embodiment is also provided with the radiator 40 operable in one of a loop antenna mode and a monopole antenna mode according to the operating frequency, it is possible to effectively achieve dual-band operation, and achieve the size reduction of the antenna apparatus. Further, it is possible to achieve the high frequency operating band, including the high-band resonance frequency f2, with an ultra wide bandwidth.

The wireless communication apparatus of FIG. 54 can use any of the other antenna apparatuses disclosed here or its modifications, instead of the antenna apparatus of FIG. 1.

The embodiments and modified embodiments described above may be combined with each other. For example, the antenna apparatus of the first embodiment and the antenna apparatus of FIG. 22 may be combined, and both the outer perimeter of the looped radiation conductors and an edge of the ground conductor may be shaped such that in a portion where the radiation conductors 1, 2 and the ground conductor G1 are close to each other, the distance between the radiation conductors 1, 2 and the ground conductor G1 gradually increases as the distance from the feed point P1 along the looped radiation conductor increases. Similarly, the antenna apparatus of the second embodiment and the antenna apparatus of FIG. 23 may be combined, and both the radiation conductors of the radiator and the ground surface of the ground conductor may be shaped such that in a portion where the radiation conductors 1, 2 and the ground conductor G1 are opposed to each other, the distance between the radiation conductors 1, 2 and the ground conductor G1 gradually increases as the distance from the feed point P1 along the looped radiation conductor increases.

Implementation Example 1

Simulation results for the antenna apparatuses according to the embodiments of the present disclosure will be described below. In the simulations, a transient analysis was performed using software, "CST Microwave Studio". A point at which reflection energy at the feed point is −40 dB or less with respect to input energy was used as a threshold value for determining convergence. A portion where a current flows strongly was finely modeled using the sub-mesh method.

Figure 40:
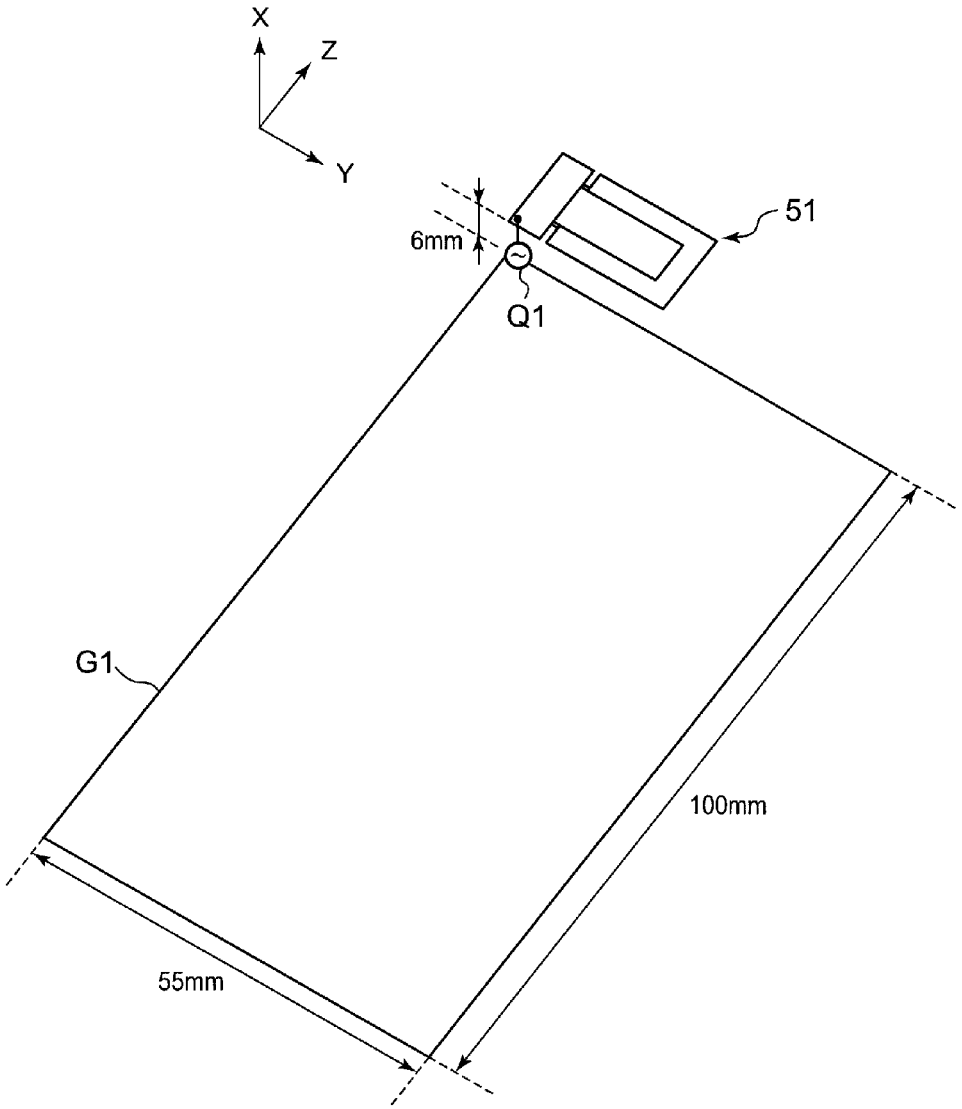
FIG. 40 is a perspective view showing an antenna apparatus according to a first comparison example used in a simulation.
Figure 41:
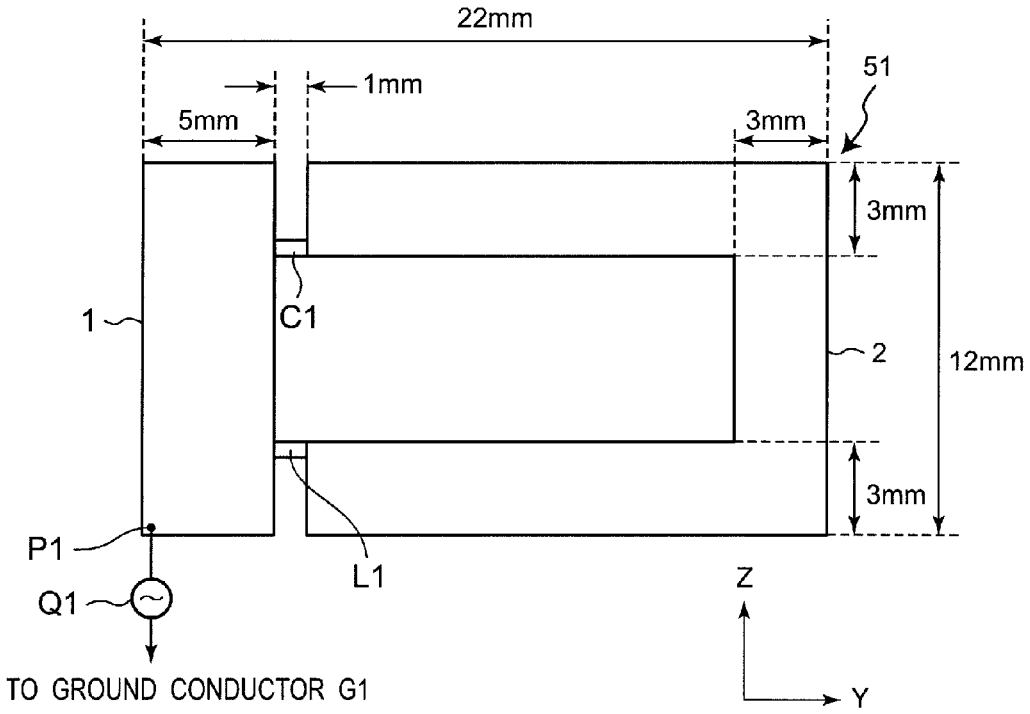
FIG. 41 is a top view showing a detailed configuration of a radiator 51 of the antenna apparatus of FIG. 40.
Figure 42:
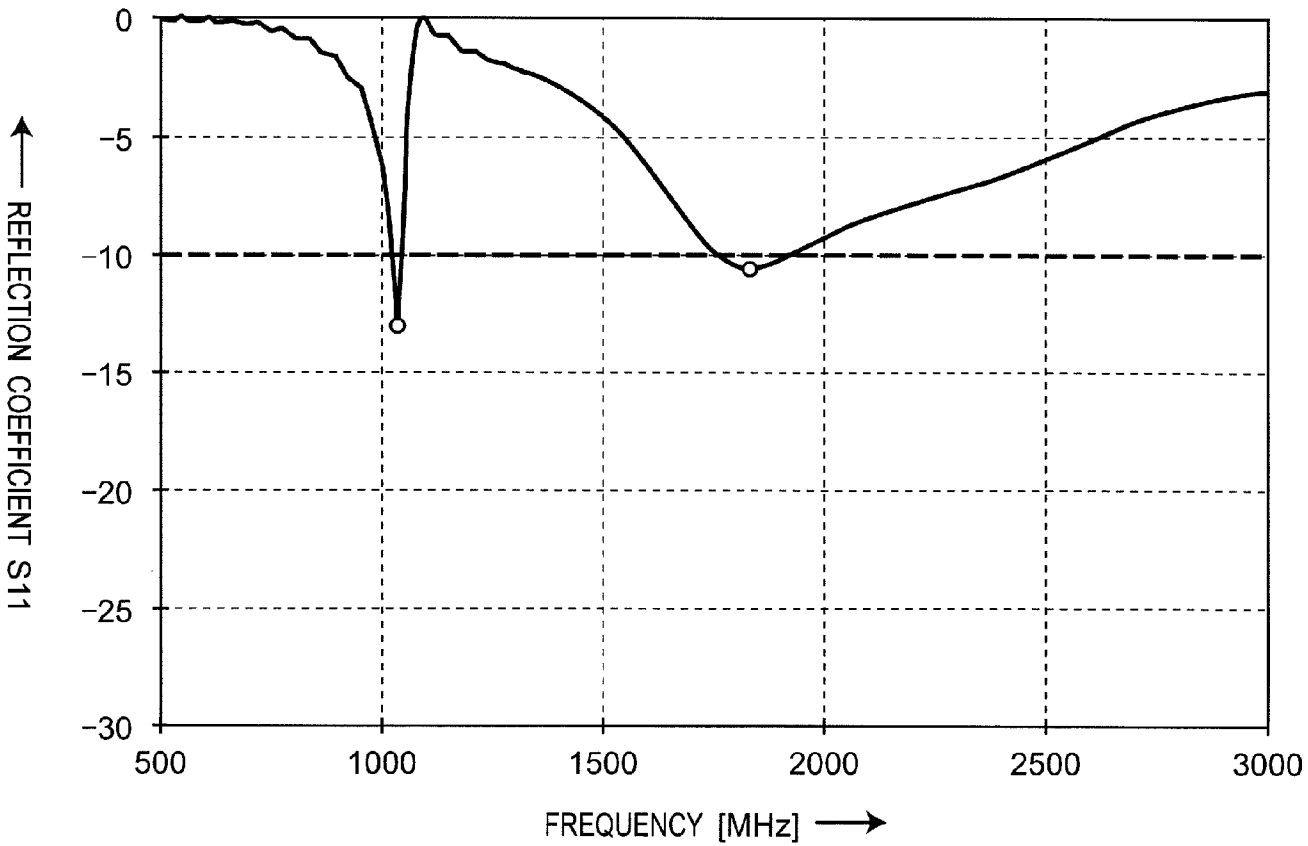
FIG. 42 is a graph showing a frequency characteristic of a reflection coefficient S11 of the antenna apparatus of FIG. 40.
Figure 43:
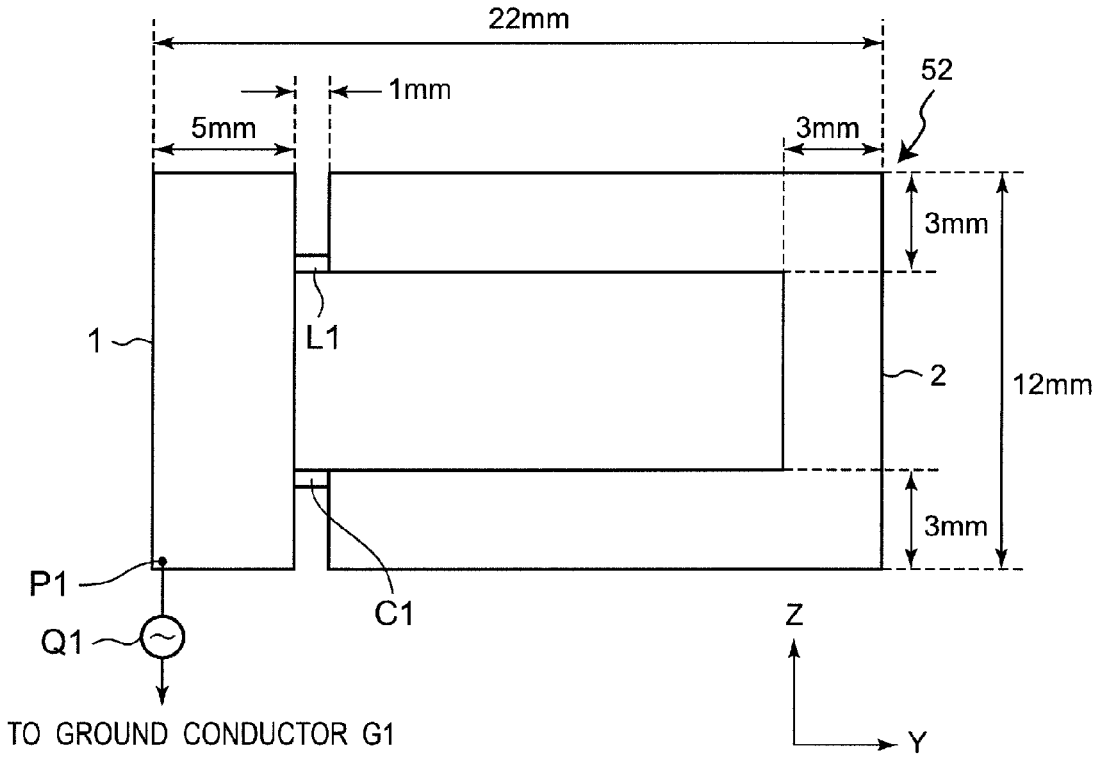
FIG. 43 is a top view showing a radiator 52 of an antenna apparatus according to a second comparison example used in a simulation.
Figure 44:
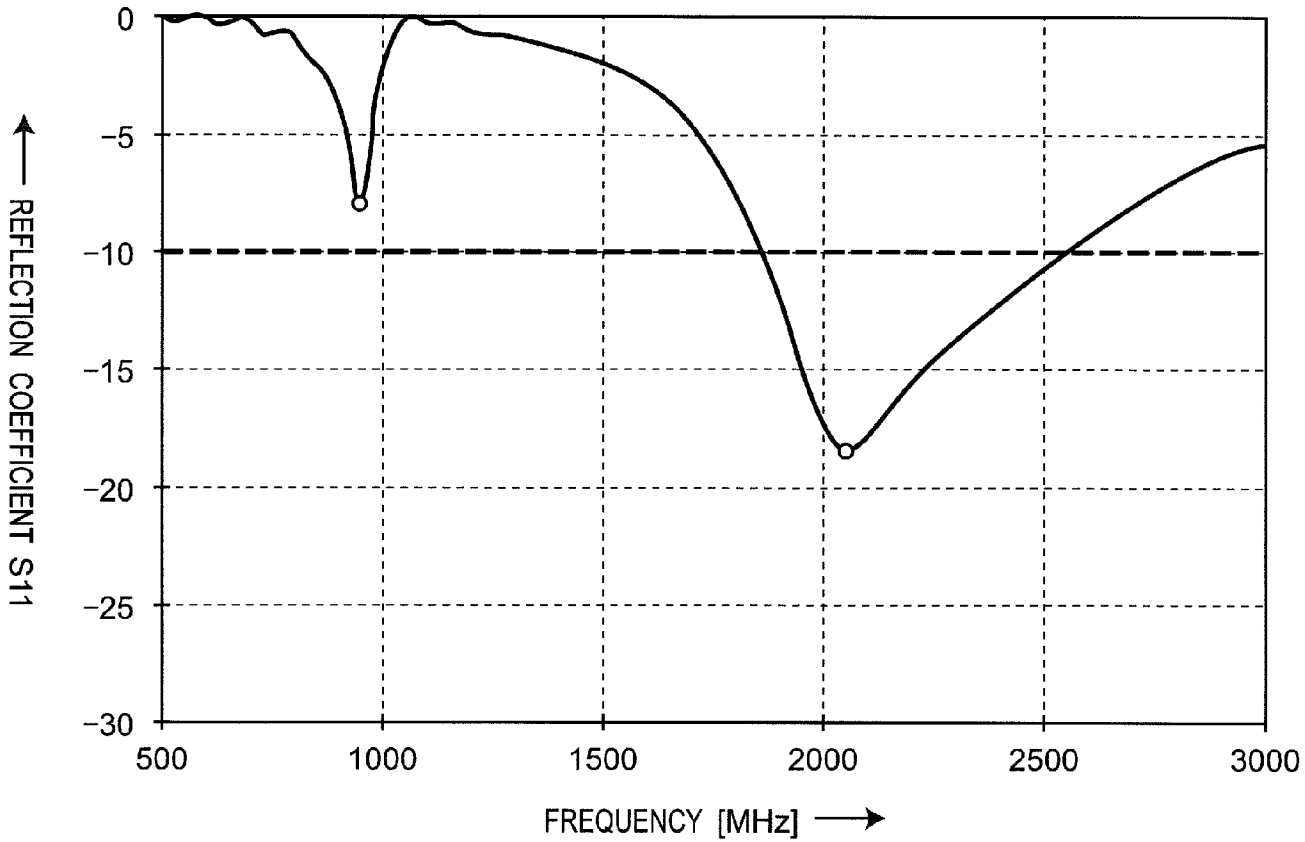
FIG. 44 is a graph showing a frequency characteristic of a reflection coefficient S11 of the antenna apparatus of FIG. 43.

FIG. 40 is a perspective view showing an antenna apparatus according to a first comparison example used in a simulation. FIG. 41 is a top view showing a detailed configuration of a radiator 51 of the antenna apparatus of FIG. 40. A capacitor C1 had a capacitance of 1 pF, an inductor L1 had an inductance of 3 nH. The capacitor C1 of the same capacitance and the inductor L1 of the inductance were used in the other simulations. FIG. 42 is a graph showing a frequency characteristic of a reflection coefficient S11 of the antenna apparatus of FIG. 40. The reflection coefficient S11 is −13.1 dB at the low-band resonance frequency f1=1035 MHz, and the reflection coefficient S11 is −10.6 dB at the high-band resonance frequency f2=1844 MHz. FIG. 43 is a top view showing a radiator 52 of an antenna apparatus according to a second comparison example used in a simulation. The radiator 52 of FIG. 43 is arranged with respect to a ground conductor G1 in a manner similar to that of the radiator 51 of FIG. 40 (the same applies to the other simulations). FIG. 44 is a graph showing a frequency characteristic of a reflection coefficient S11 of the antenna apparatus of FIG. 43. The reflection coefficient S11 is −7.6 dB at the low-band resonance frequency f1=949 MHz, and the reflection coefficient S11 is −18.2 dB at the high-band resonance frequency f2=2050 MHz. According to FIGS. 42 and 44, it can be seen that the antenna apparatuses of the comparison examples can also effectively achieve dual-band characteristics.

Figure 45:
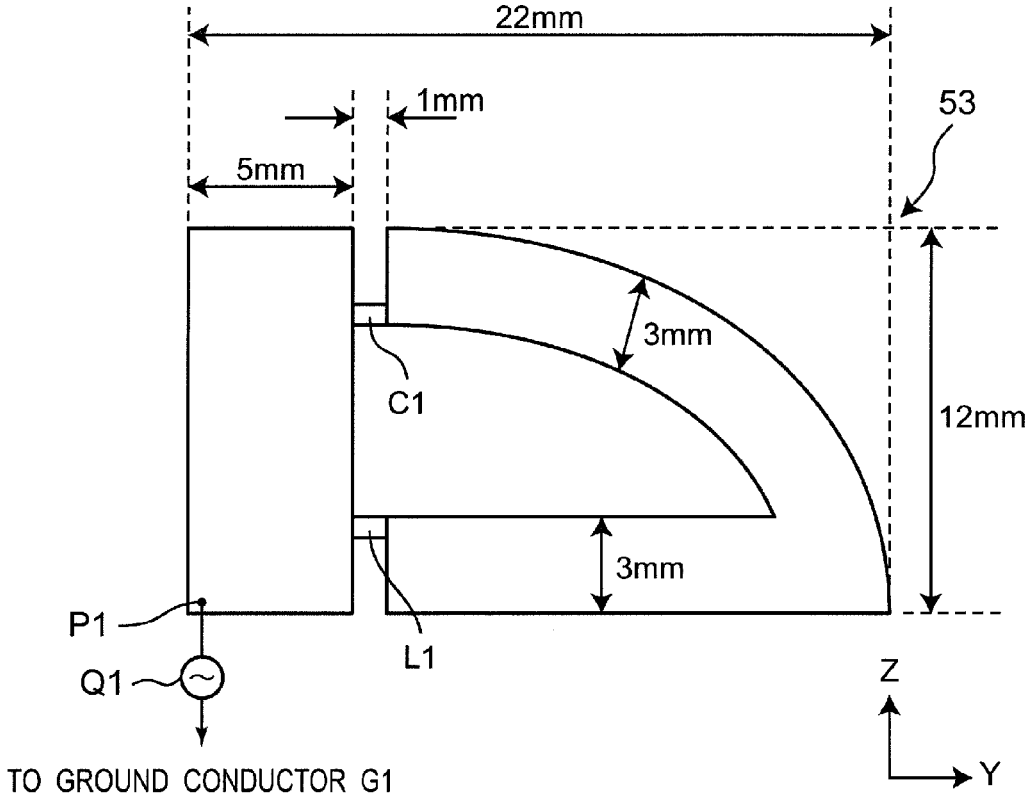
FIG. 45 is a top view showing a radiator 53 of an antenna apparatus according to a third comparison example used in a simulation.
Figure 46:
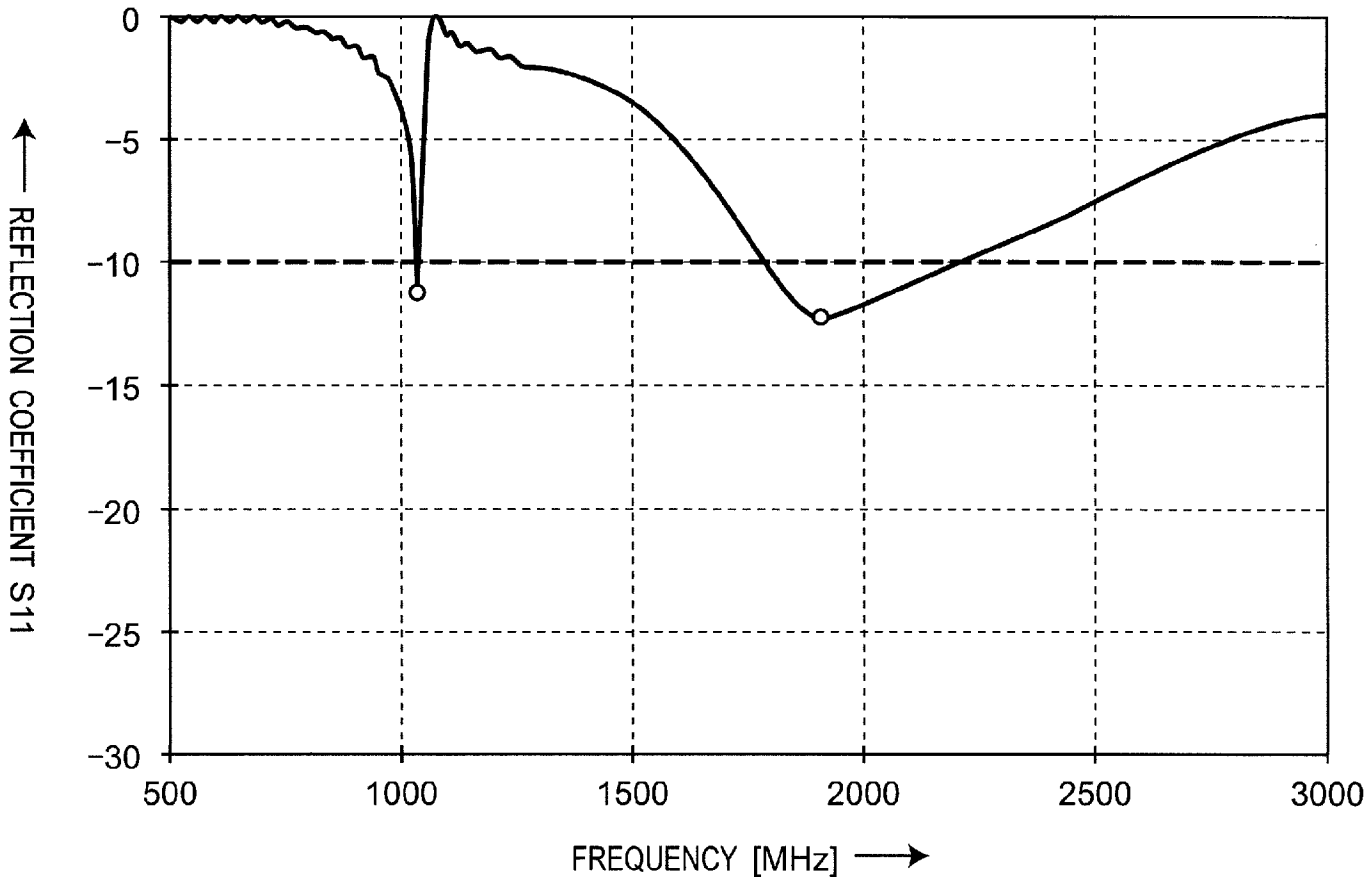
FIG. 46 is a graph showing a frequency characteristic of a reflection coefficient S11 of the antenna apparatus of FIG. 45.
Figure 47:
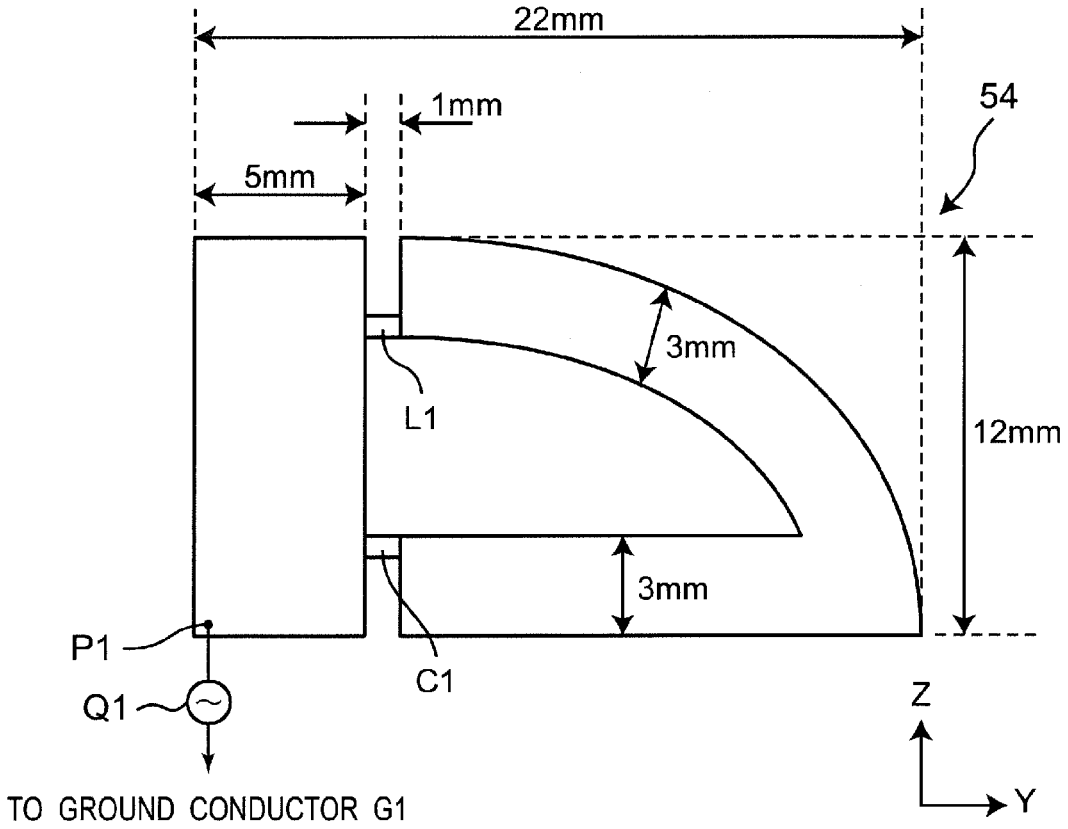
FIG. 47 is a top view showing a radiator 54 of an antenna apparatus according to a fourth comparison example used in a simulation.
Figure 48:
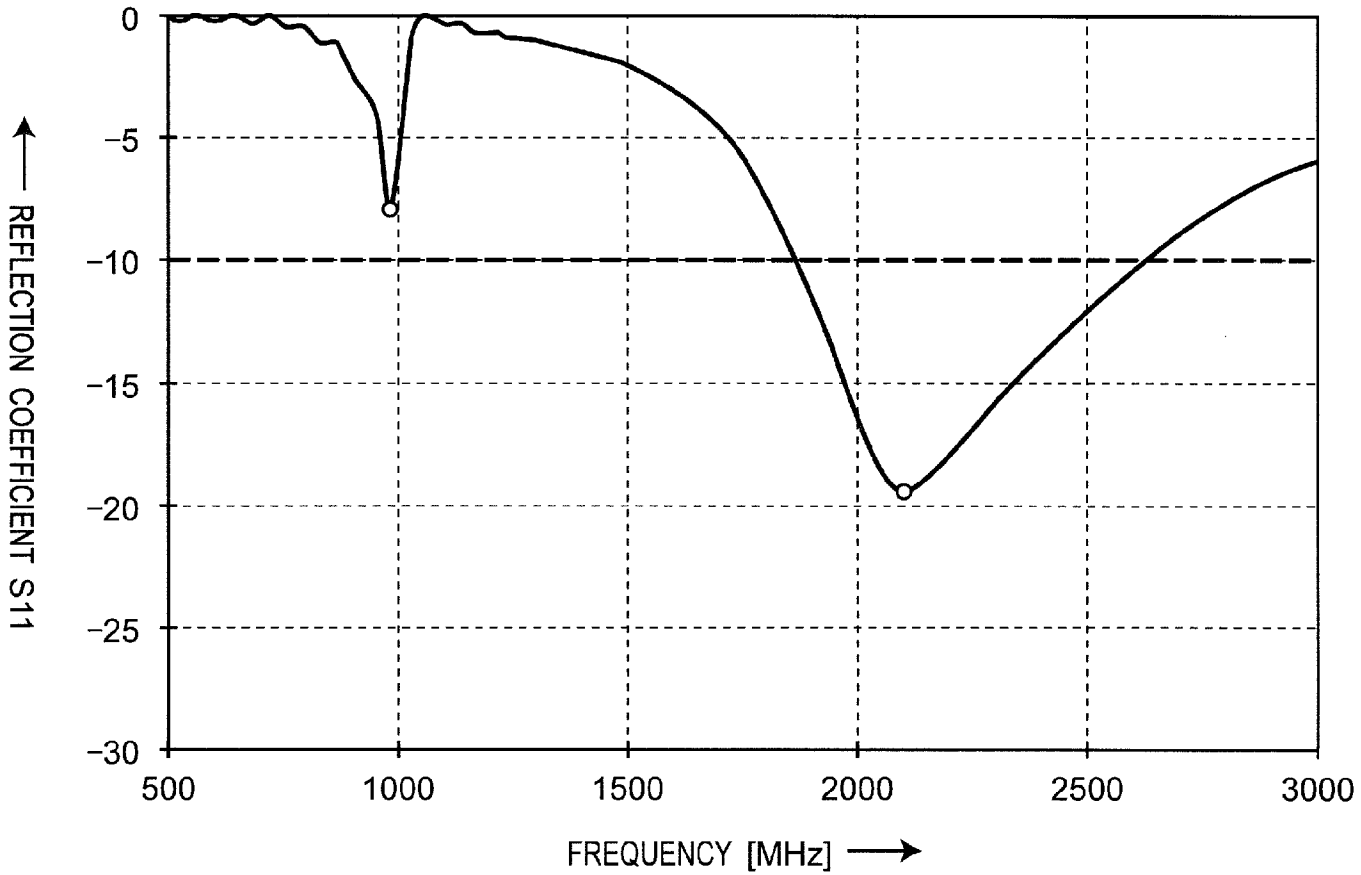
FIG. 48 is a graph showing a frequency characteristic of a reflection coefficient S11 of the antenna apparatus of FIG. 47.

FIG. 45 is a top view showing a radiator 53 of an antenna apparatus according to a third comparison example used in a simulation. The outer perimeter of a looped radiation conductor of the antenna apparatus of FIG. 45 is tapered near its open end. FIG. 46 is a graph showing a frequency characteristic of a reflection coefficient S11 of the antenna apparatus of FIG. 45. The reflection coefficient S11 is −11.1 dB at the low-band resonance frequency f1=1040 MHz, and the reflection coefficient S11 is −12.1 dB at the high-band resonance frequency f2=1914 MHz. FIG. 47 is a top view showing a radiator 54 of an antenna apparatus according to a fourth comparison example used in a simulation. The outer perimeter of a looped radiation conductor of the antenna apparatus of FIG. 47 is tapered near its open end. FIG. 48 is a graph showing a frequency characteristic of a reflection coefficient S11 of the antenna apparatus of FIG. 47. The reflection coefficient S11 is −7.9 dB at the low-band resonance frequency f1=983 MHz and the reflection coefficient S11 is −19.3 dB at the high-band resonance frequency f2=2103 MHz. According to FIGS. 46 and 48, it can be seen that dual-band characteristics can be effectively achieved. In addition, comparing with the graphs of FIGS. 42 and 44, it can be seen that there is no significant change in characteristics for the case where the antenna apparatuses operate at the low-band resonance frequency f1, and on the other hand, when the antenna apparatuses of FIGS. 45 and 47 operate at the high-band resonance frequency f2, the operating frequency band is slightly widened due to the tapered portion near the open end. However, an ultra wide bandwidth is not achieved.

Figure 49:
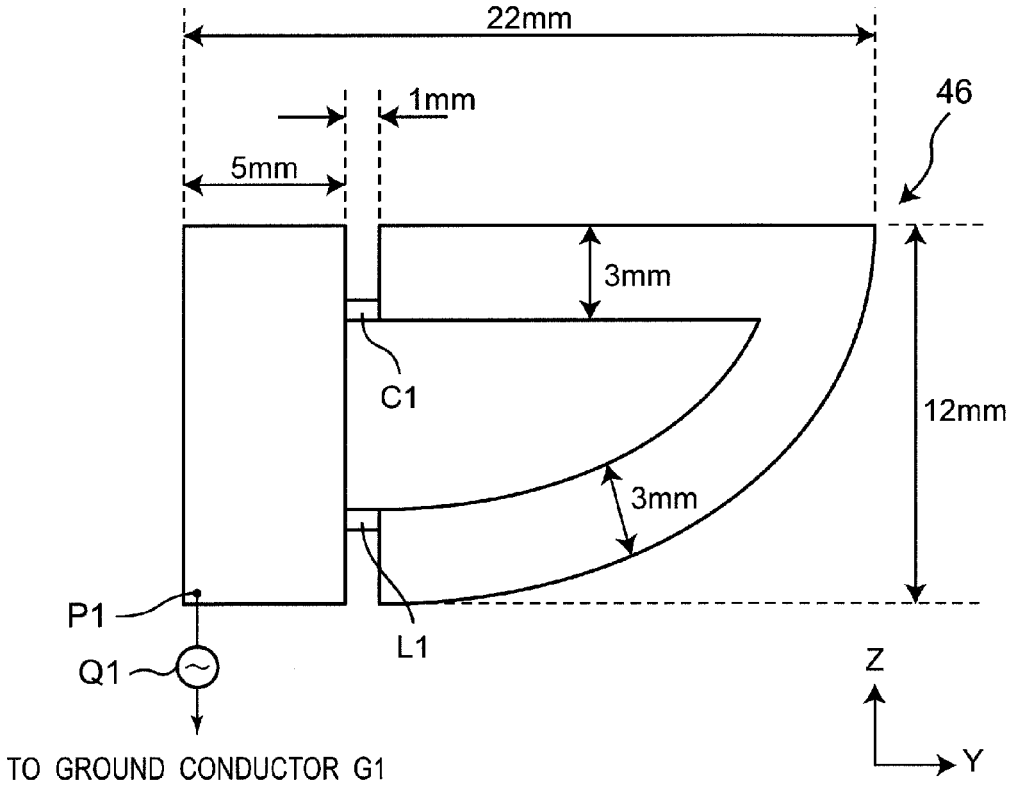
FIG. 49 is a top view showing a radiator 46 of an antenna apparatus according to a first implementation example of the first embodiment used in a simulation.
Figure 50:
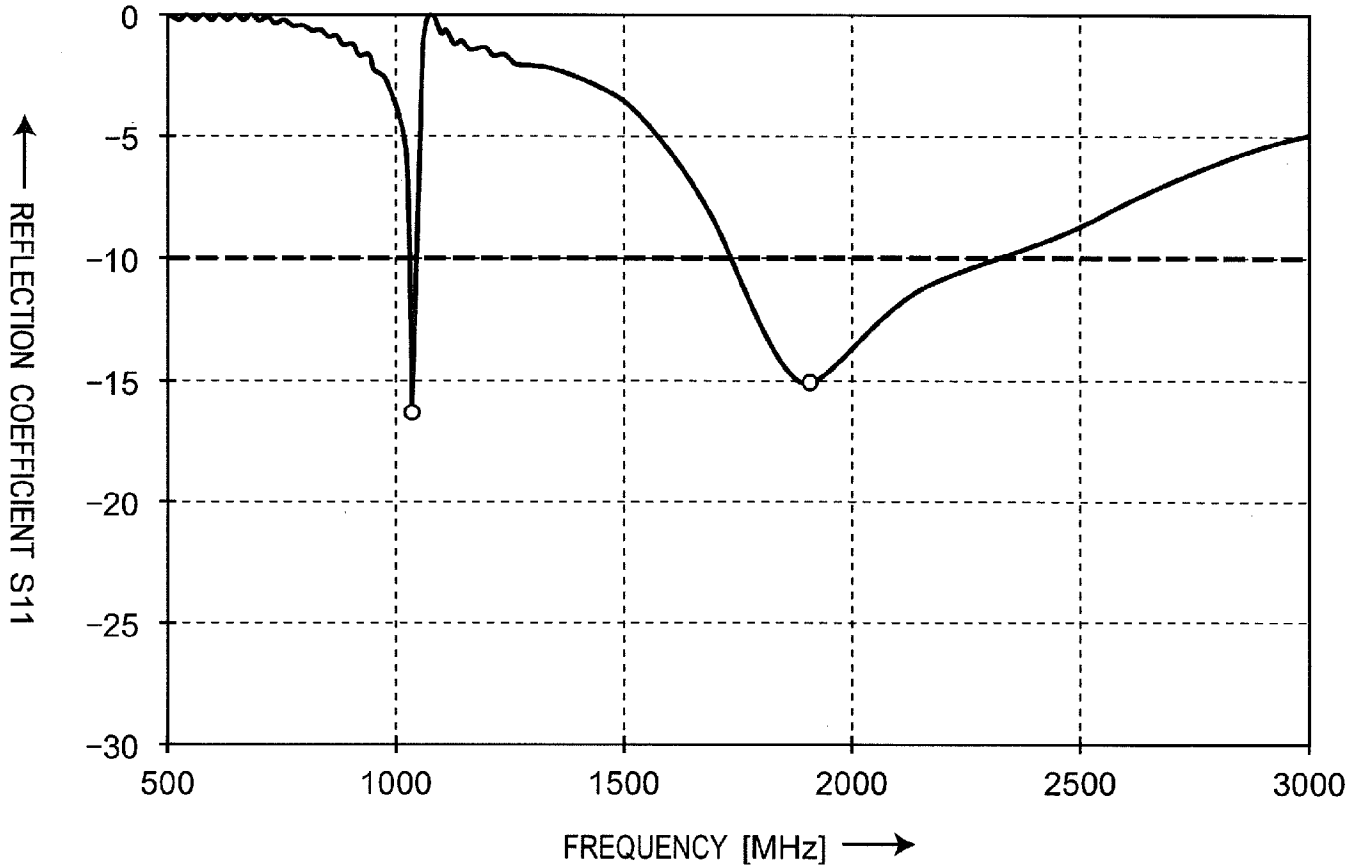
FIG. 50 is a graph showing a frequency characteristic of a reflection coefficient S11 of the antenna apparatus of FIG. 49.
Figure 51:
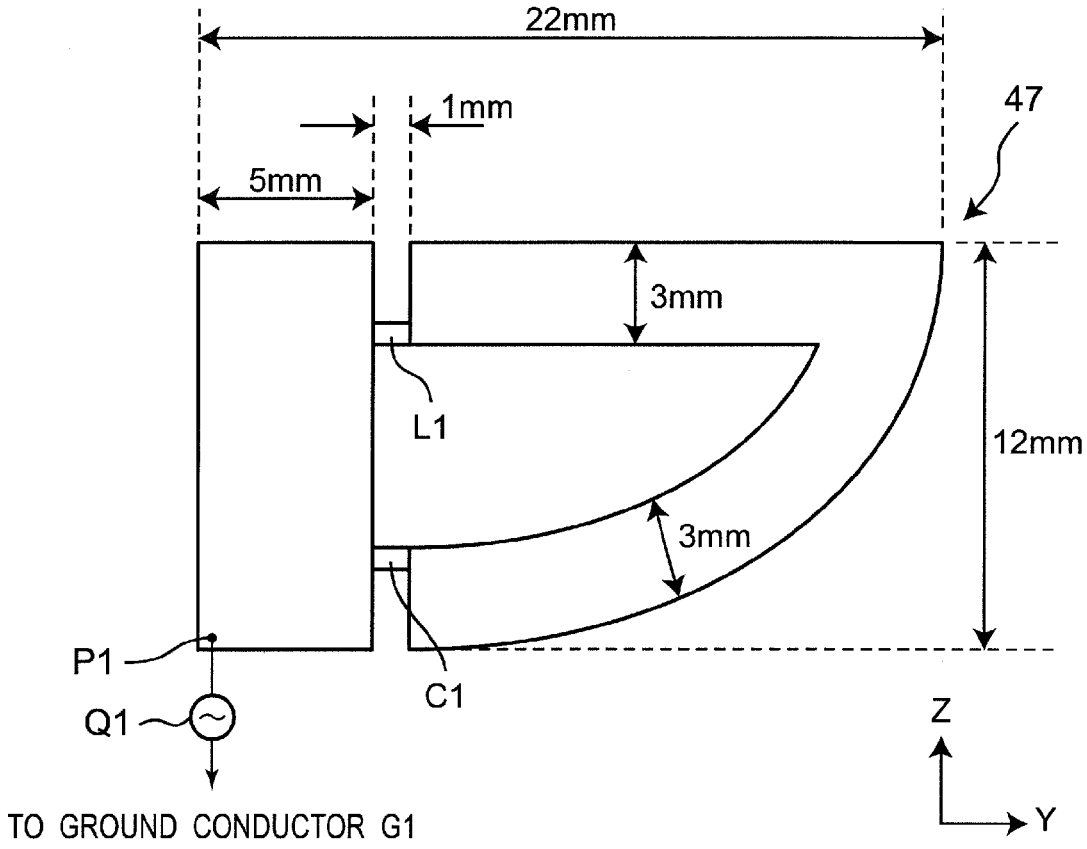
FIG. 51 is a top view showing a radiator 47 of an antenna apparatus according to a second implementation example of the first embodiment used in a simulation.
Figure 52:
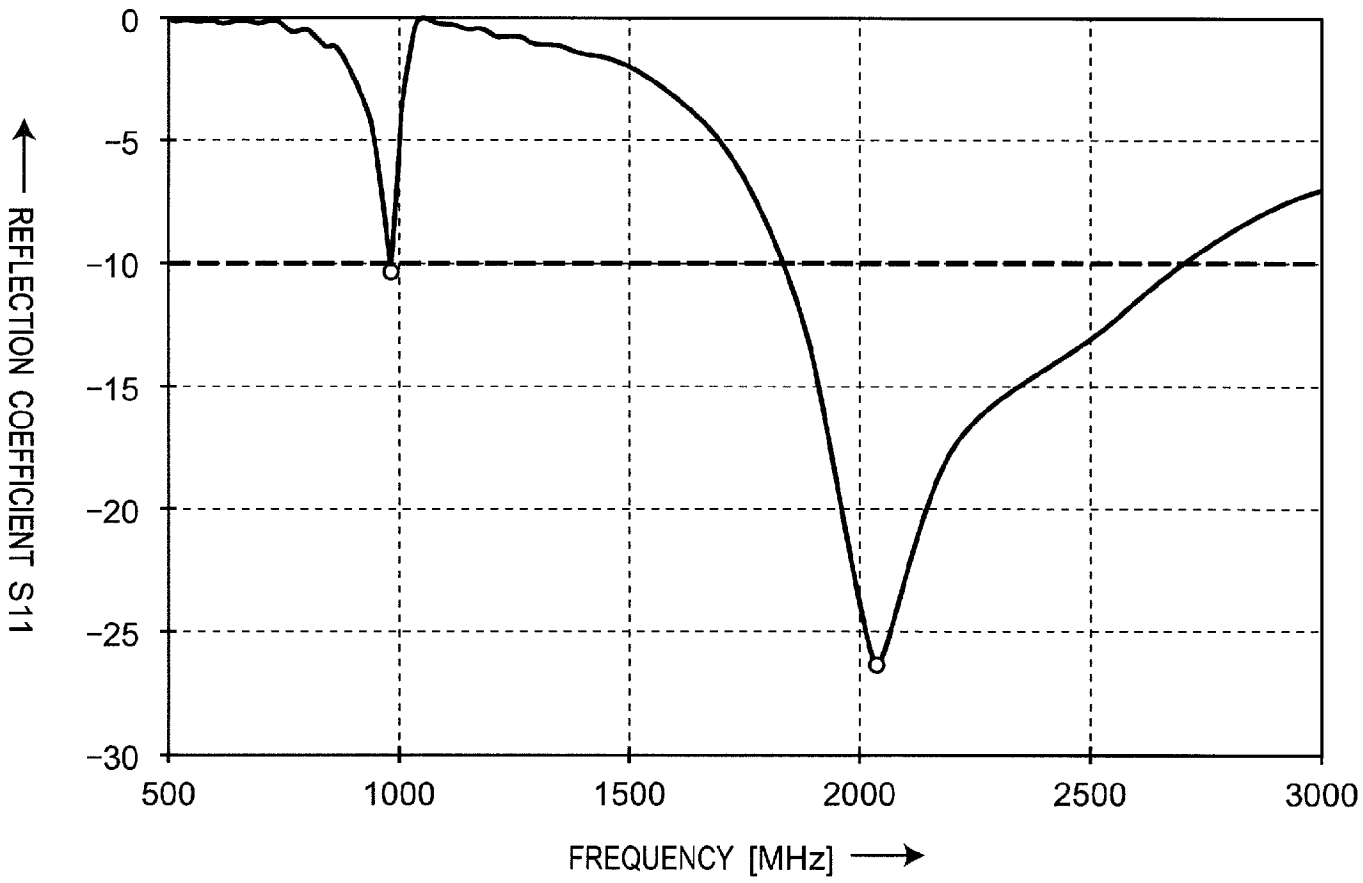
FIG. 52 is a graph showing a frequency characteristic of a reflection coefficient S11 of the antenna apparatus of FIG. 51.

FIG. 49 is a top view showing a radiator 46 of an antenna apparatus according to a first implementation example of the first embodiment used in a simulation. FIG. 50 is a graph showing a frequency characteristic of a reflection coefficient S11 of the antenna apparatus of FIG. 49. The reflection coefficient S11 is −16.2 dB at the low-band resonance frequency f1=1043 MHz, and the reflection coefficient S11 is −15.1 dB at the high-band resonance frequency f2=1903 MHz. FIG. 51 is a top view showing a radiator 47 of an antenna apparatus according to a second implementation example of the first embodiment used in a simulation. FIG. 52 is a graph showing a frequency characteristic of a reflection coefficient S11 of the antenna apparatus of FIG. 51. The reflection coefficient S11 is −10.5 dB at the low-band resonance frequency f1=985 MHz, and the reflection coefficient S11 is −26.2 dB at the high-band resonance frequency f2=2051 MHz. According to FIGS. 50 and 52, it can be seen that dual-band characteristics can be effectively achieved. Comparing with the graphs of FIGS. 46 and 48, it can be seen that there is no significant change in characteristics for the case where the antenna apparatuses operate at the low-band resonance frequency f1, and on the other hand, when the antenna apparatuses of FIGS. 49 and 51 operate at the second resonance frequency f2, the antenna apparatuses of FIGS. 49 and 51 can more effectively achieve a wider bandwidth, because the outer perimeter of a looped radiation conductor is shaped such that in a portion where radiation conductors 1, 2 and a ground conductor G1 are close to each other, the distance from the ground conductor G1 thereto gradually increases as the distance from a feed point P1 along the loop of the radiation conductor increases. However, it is judged that the antenna apparatus of FIG. 49 having an inductor L1 near the ground conductor G1 does not have a sufficiently widened bandwidth. This is because a current path for the case where the antenna apparatus operates at the high-band resonance frequency f2 passes through a capacitor C1, and thus, a current does not strongly flow along a portion of the radiation conductor near the inductor L1.

Figure 53:
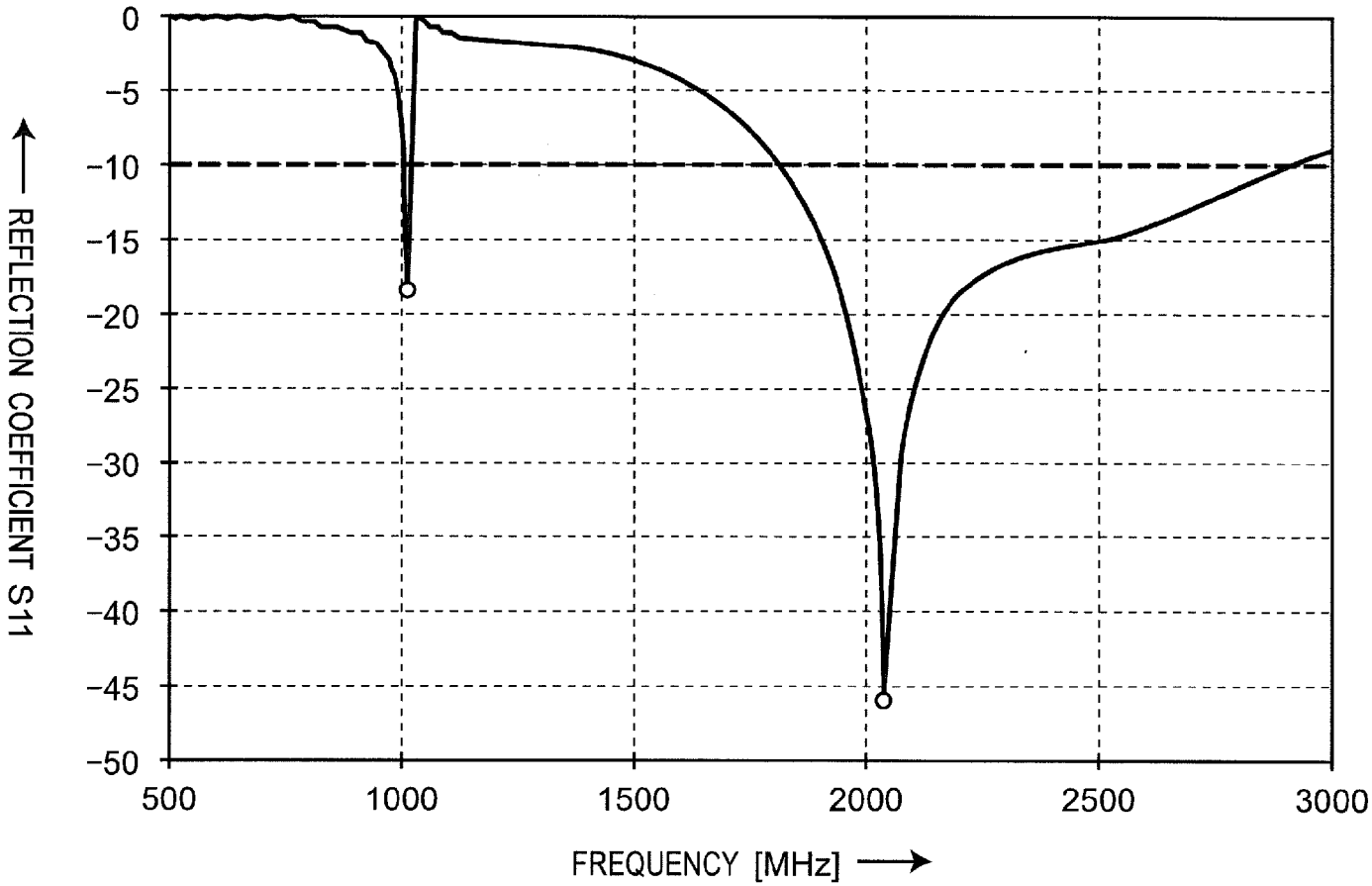
FIG. 53 is a graph showing a frequency characteristic of a reflection coefficient S11 of an antenna apparatus according to an implementation example of the second embodiment used in a simulation.

FIG. 53 is a graph showing a frequency characteristic of a reflection coefficient S11 of an antenna apparatus according to an implementation example of the second embodiment used in a simulation. In the simulation shown in FIG. 53, a radiation conductor 1*c* of FIG. 20 is used instead of a radiation conductor 1 of the radiator 46 of FIG. 49. The reflection coefficient S11 is −18.7 dB at the low-band resonance frequency f1=1010 MHz, and the reflection coefficient S11 is −45.8 dB at the high-band resonance frequency f2=2037 MHz. According to FIG. 53, it is possible to effectively achieve dual-band characteristics, and achieve the operating frequency band, including the high-band resonance frequency f2, with an ultra wide bandwidth, ranging from 1810 to 2620 MHz. According to the above results, the antenna apparatuses according to the embodiments of the present disclosure can provide antenna apparatuses operable in multiple bands, while having a simple and small configuration, and achieve a high operating frequency band with an ultra wide bandwidth.

For the reference, Table 1 shows operating bandwidths for the cases where the respective antenna apparatuses operate at the high-band resonance frequency f2 (i.e., frequency bands where S11≤−10 dB).

TABLE 1

| | |
|---|---|
| FIG. 42 | 170 MHz |
| FIG. 44 | 680 MHz |
| FIG. 46 | 406 MHz |
| FIG. 48 | 740 MHz |
| FIG. 50 | 577 MHz |
| FIG. 52 | 864 MHz |
| FIG. 53 | 1079 MHz |

According to the simulation results, it has been verified through various antenna models that it is possible to obtain a special advantageous effect of achieving the operating frequency band, including the high-band resonance frequency f2, with an ultra wide bandwidth, without impairing characteristics for the case where the antenna apparatus operates at the low-band resonance frequency f1, because the antenna apparatus is configured such that in a portion where the radiation conductors 1, 2 and the ground conductor G1 are close to each other, the distance between the radiation conductors 1, 2 and the ground conductor G1 gradually increases as the distance from the feed point P1 along the looped radiation conductor increases.

The frequency characteristics of the designed antenna apparatuses are mere examples, and the frequency characteristics are not limited thereto. It is possible to improve the performance through optimization of a frequency band according to the required system, such as the frequency bands for cellular, a wireless LAN, or GPS, etc., including optimization of a matching circuit, etc.

Summary of Embodiments

The antenna apparatuses and wireless communication apparatuses disclosed here are characterized by the following configurations.

According to an antenna apparatus of a first aspect of the present disclosure, the antenna apparatus is provided with at least one radiator and a ground conductor. Each radiator is provided with: a looped radiation conductor having an inner perimeter and an outer perimeter, the radiation conductor being positioned with respect to the ground conductor such that a part of the radiation conductor is close to and electromagnetically coupled to the ground conductor; at least one capacitor inserted at a position along a loop of the radiation conductor; at least one inductor inserted at a position along the loop of the radiation conductor, the position of the inductor being different from the position of the capacitor; and a feed point provided at a position on the radiation conductor, the position of the feed point being close to the ground conductor. The antenna apparatus is configured such that in a portion where the radiation conductor of each radiator and the ground conductor are close to each other, a distance between the radiation conductor and the ground conductor gradually increases as a distance from the feed point along the loop of the radiation conductor increases. Each radiator is excited at a first frequency and at a second frequency higher than the first frequency. When each radiator is excited at the first frequency, a first current flows along a first path, the first path extending along the inner perimeter of the loop of the radiation conductor and including the inductor and the capacitor. When each radiator is excited at the second frequency, a second current flows through a second path including a section, the section extending along the outer perimeter of the loop of the radiation conductor, and the section including the capacitor but not including the inductor, and the section extending between the feed point and the inductor. When each radiator is excited at the second frequency, in the portion where the radiation conductor of each radiator and the ground conductor are close to each other, a resonant circuit is formed from: capacitance distributed between the radiation conductor and the ground conductor; and inductance distributed over the radiation conductor. Each radiator is configured such that the loop of the radiation conductor, the inductor, and the capacitor resonate at the first frequency, and a portion of the loop of the radiation conductor included in the second path, the capacitor, and the resonant circuit resonate at the second frequency.

According to an antenna apparatus of a second aspect of the present disclosure, in the antenna apparatus of the first aspect, the outer perimeter of the loop of the radiation conductor of each radiator is shaped such that a distance from the ground conductor thereto gradually increases as the distance from the feed point along the loop of the radiation conductor increases.

According to an antenna apparatus of a third aspect of the present disclosure, in the antenna apparatus of the first aspect, the ground conductor has an edge close to the radiation conductor of each radiator. The edge is shaped such that a distance from the radiation conductor thereto gradually increases as the distance from the feed point along the loop of the radiation conductor of each radiator increases.

According to an antenna apparatus of a fourth aspect of the present disclosure, in the antenna apparatus of one of the first to third aspects, a ground surface of the ground conductor is provided on a first surface. The radiation conductor of each radiator is provided on a second surface at least partially opposing to the first surface, and is provided such that a distance from the ground surface of the ground conductor thereto gradually increases as the distance from the feed point along the loop of the radiation conductor increases.

According to an antenna apparatus of a fifth aspect of the present disclosure, in the antenna apparatus of one of the first to third aspects, a ground surface of the ground conductor is provided on a first surface. The radiation conductor of each radiator is provided on a second surface at least partially opposing to the first surface. The ground surface of the ground conductor is shaped such that a distance from the radiation conductor thereto gradually increases as the distance from the feed point along the loop of the radiation conductor increases.

According to an antenna apparatus of a sixth aspect of the present disclosure, in the antenna apparatus of one of the first to fifth aspects, a distance between the radiation conductor and the ground conductor gradually increases as proceeding from the feed point in a first direction along the loop of the radiation conductor of each radiator. The distance between the radiation conductor and the ground conductor gradually increases as proceeding from the feed point in a second direction opposite to the first direction along the loop of the radiation conductor.

According to an antenna apparatus of a seventh aspect of the present disclosure, in the antenna apparatus of one of the first to sixth aspects, the capacitor and the inductor of each radiator are provided along the loop of the radiation conductor and at a portion where the radiation conductor and the ground conductor are close to each other. The feed point is provided between the capacitor and the inductor.

According to an antenna apparatus of an eighth aspect of the present disclosure, in the antenna apparatus of one of the first to seventh aspects, the radiation conductor includes a first radiation conductor and a second radiation conductor. The capacitor is formed from capacitance between the first and second radiation conductors.

According to an antenna apparatus of a ninth aspect of the present disclosure, in the antenna apparatus of one of the first to eighth aspects, the inductor is formed as a strip conductor.

According to an antenna apparatus of a tenth aspect of the present disclosure, in the antenna apparatus of one of the first to eighth aspects, the inductor is formed as a meander conductor.

According to an antenna apparatus of an eleventh aspect of the present disclosure, the antenna apparatus of one of the first to tenth aspects is provided with a printed circuit board, the printed circuit board being provided with the ground conductor, and a feed line connected to the feed point. The radiator is formed on the printed circuit board.

According to an antenna apparatus of a twelfth aspect of the present disclosure, in the antenna apparatus of one of the first to tenth aspects, the antenna apparatus is a dipole antenna, including a first radiator, and including a second radiator instead of the ground conductor.

According to an antenna apparatus of a thirteenth aspect of the present disclosure, the antenna apparatus of one of the first to twelfth aspects is provided with a plurality of radiators. The plurality of radiators have a plurality of different first frequencies and a plurality of different second frequencies, respectively.

According to an antenna apparatus of a fourteenth aspect of the present disclosure, in the antenna apparatus of one of the first to thirteenth aspects, the antenna apparatus is configured as an inverted-F antenna.

According to an antenna apparatus of a fifteenth aspect of the present disclosure, in the antenna apparatus of one of the first to fourteenth aspects, the radiation conductor is bent at at least one position.

According to an antenna apparatus of a sixteenth aspect of the present disclosure, in the antenna apparatus of one of the first to fourteenth aspects, the radiation conductor is curved at at least one position.

According to an antenna apparatus of a seventeenth aspect of the present disclosure, the antenna apparatus of one of the first to sixteenth aspects is provided with a plurality of radiators connected to different signal sources.

According to an antenna apparatus of a eighteenth aspect of the present disclosure, the antenna apparatus of the seventeenth aspect is provided with a first radiator and a second radiator, the first and second radiators having respective radiation conductors formed to be symmetrical with respect to a reference axis. Respective feed points of the first and second radiators are provided at positions symmetrical with respect to the reference axis. The radiation conductors of the first and second radiators are shaped such that a distance between the first and second radiators gradually increases as a distance from the feed points of the first and second radiators along the reference axis increases.

According to an antenna apparatus of a nineteenth aspect of the present disclosure, the antenna apparatus of the seventeenth or eighteenth aspect is provided with a first radiator and a second radiator. Respective loops of radiation conductors of the first and second radiators are formed to be substantially symmetrical with respect to a reference axis. When proceeding along the respective symmetric loops of the radiation conductors of the first and second radiators in corresponding directions starting from the respective feed points, the first radiator is configured such that the feed point, the inductor, and the capacitor are located in this order, and the second radiator is configured such that the feed point, the capacitor, and the inductor are located in this order.

According to a wireless communication apparatus of a twentieth aspect of the present disclosure, the wireless communication apparatus is provided with the antenna apparatus of one of the first to nineteenth aspects.

INDUSTRIAL APPLICABILITY

As described above, an antenna apparatus of the present disclosure is operable in multiple bands, while having a simple and small configuration. In addition, when including a plurality of radiators, the antenna apparatus of the present disclosure has low coupling between antenna elements, and is operable to simultaneously transmit or receive a plurality of radio signals. In addition, according to the present disclosure, it is possible to provide wireless communication apparatuses including such antenna apparatuses.

According to the antenna apparatus of the present disclosure and the wireless communication apparatus using the antenna apparatus, they can be implemented as, for example, mobile phones, or can also be implemented as apparatuses for wireless LAN, smart phones, etc. The antenna apparatus can be mounted on, for example, wireless communication apparatuses for MIMO communication. In addition to MIMO, the antenna apparatus can also be mounted on (multi-application) array antenna apparatus capable of simultaneously performing communications for a plurality of applications, such as an adaptive array antenna, a maximal-ratio combining diversity antenna, and a phased-array antenna.

REFERENCE SIGNS LIST

1, 1*a*, 1*b*, 1*c*, 2, 3, 11, 12, 21, 22, and 31 to 34: RADIATION CONDUCTOR,

40 to 47, 50 to 54, 60 to 67, 70, 71, 80 to 88, and 90A to 90C: RADIATOR,

88*a*: SHORT-CIRCUIT CONDUCTOR,

101: WIRELESS TRANSMITTER AND RECEIVER CIRCUIT,

102: BASEBAND SIGNAL PROCESSING CIRCUIT,

103: SPEAKER,

104: MICROPHONE,

B1: DIELECTRIC SUBSTRATE,

C1 to C6, C11, C21, C31, and C32: CAPACITOR,

Ce: CAPACITANCE,

L1 to L5, L11, L21, L31, and L32: INDUCTOR,

La and Le: INDUCTANCE,

G1 to G4: GROUND CONDUCTOR,

P1, P11, P21, P31, and P33: FEED POINT,

P2, P32, and P34: CONNECTING POINT,

Q1, Q21, Q31, and Q32: SIGNAL SOURCE,

Rr: RADIATION RESISTANCE, and

S1: STRIP CONDUCTOR.

The invention claimed is:

1. An antenna apparatus comprising at least one radiator and a ground conductor, wherein each radiator comprises:

a looped radiation conductor having an inner perimeter and an outer perimeter, the radiation conductor being positioned with respect to the ground conductor such that a part of the radiation conductor is close to and electromagnetically coupled to the ground conductor;

at least one capacitor inserted at a position along a loop of the radiation conductor;

at least one inductor inserted at a position along the loop of the radiation conductor, the position of the inductor being different from the position of the capacitor; and a feed point provided at a position on the radiation conductor, the position of the feed point being close to the ground conductor, wherein the antenna apparatus is configured such that in a portion where the radiation conductor of each radiator and the ground conductor are close to each other, a distance between the radiation conductor and the ground conductor gradually increases as a distance from the feed point along the loop of the radiation conductor increases, wherein each radiator is excited at a first frequency and at a second frequency higher than the first frequency, wherein when each radiator is excited at the first frequency, a first current flows along a first path, the first path extending along the inner perimeter of the loop of the radiation conductor and including the inductor and the capacitor, wherein when each radiator is excited at the second frequency, a second current flows through a second path including a section, the section extending along the outer perimeter of the loop of the radiation conductor, and the section including the capacitor but not including the inductor, and the section extending between the feed point and the inductor, wherein when each radiator is excited at the second frequency, in the portion where the radiation conductor of each radiator and the ground conductor are close to each other, a resonant circuit is formed from: capacitance distributed between the radiation conductor and the ground conductor; and inductance distributed over the radiation conductor, and wherein each radiator is configured such that the loop of the radiation conductor, the inductor, and the capacitor resonate at the first frequency, and a portion of the loop of the radiation conductor included in the second path, the capacitor, and the resonant circuit resonate at the second frequency.

2. The antenna apparatus as claimed in claim 1, wherein the outer perimeter of the loop of the radiation conductor of each radiator is shaped such that a distance from the ground conductor thereto gradually increases as the distance from the feed point along the loop of the radiation conductor increases.

3. The antenna apparatus as claimed in claim 1, wherein the ground conductor has an edge close to the radiation conductor of each radiator, and wherein the edge is shaped such that a distance from the radiation conductor thereto gradually increases as the distance from the feed point along the loop of the radiation conductor of each radiator increases.

4. The antenna apparatus as claimed in claim 1, wherein a ground surface of the ground conductor is provided on a first surface, and wherein the radiation conductor of each radiator is provided on a second surface at least partially opposing to the first surface, and is provided such that a distance from the ground surface of the ground conductor thereto gradually increases as the distance from the feed point along the loop of the radiation conductor increases.

5. The antenna apparatus as claimed in claim 1, wherein a ground surface of the ground conductor is provided on a first surface, wherein the radiation conductor of each radiator is provided on a second surface at least partially opposing to the first surface, and wherein the ground surface of the ground conductor is shaped such that a distance from the radiation conductor thereto gradually increases as the distance from the feed point along the loop of the radiation conductor increases.

6. The antenna apparatus as claimed in claim 1, wherein a distance between the radiation conductor and the ground conductor gradually increases as proceeding from the feed point in a first direction along the loop of the radiation conductor of each radiator, and wherein the distance between the radiation conductor and the ground conductor gradually increases as proceeding from the feed point in a second direction opposite to the first direction along the loop of the radiation conductor.

7. The antenna apparatus as claimed in claim 1, wherein the capacitor and the inductor of each radiator are provided along the loop of the radiation conductor and at a portion where the radiation conductor and the ground conductor are close to each other, and wherein the feed point is provided between the capacitor and the inductor.

8. The antenna apparatus as claimed in claim 1, wherein the radiation conductor includes a first radiation conductor and a second radiation conductor, and wherein the capacitor is formed from capacitance between the first and second radiation conductors.

9. The antenna apparatus as claimed in claim 1, wherein the inductor is formed as a strip conductor.

10. The antenna apparatus as claimed in claim 1, wherein the inductor is formed as a meander conductor.

11. The antenna apparatus as claimed in claim 1, comprising a printed circuit board comprising the ground conductor, and a feed line connected to the feed point, wherein the radiator is formed on the printed circuit board.

12. The antenna apparatus as claimed in claim 1, wherein the antenna apparatus is a dipole antenna, including a first radiator, and including a second radiator instead of the ground conductor.

13. The antenna apparatus as claimed in claim 1, comprising a plurality of radiators, wherein the plurality of radiators have a plurality of different first frequencies and a plurality of different second frequencies, respectively.

14. The antenna apparatus as claimed in claim 1, wherein the antenna apparatus is configured as an inverted-F antenna.

15. The antenna apparatus as claimed in claim 1, wherein the radiation conductor is bent at at least one position.

16. The antenna apparatus as claimed in claim 1, wherein the radiation conductor is curved at at least one position.

17. The antenna apparatus as claimed in claim 1, comprising a plurality of radiators connected to different signal sources.

18. The antenna apparatus as claimed in claim 17, comprising a first radiator and a second radiator, the first and second radiators having respective radiation conductors formed to be symmetrical with respect to a reference axis, wherein respective feed points of the first and second radiators are provided at positions symmetrical with respect to the reference axis, and wherein the radiation conductors of the first and second radiators are shaped such that a distance between the first and second radiators gradually increases as a distance from the feed points of the first and second radiators along the reference axis increases.

19. The antenna apparatus as claimed in claim 17, comprising a first radiator and a second radiator, wherein respective loops of radiation conductors of the first and second radiators are formed to be substantially symmetrical with respect to a reference axis, and wherein when proceeding along the respective symmetric loops of the radiation conductors of the first and second radiators in corresponding directions starting from the respective feed points, the first radiator is configured such that the feed point, the inductor, and the capacitor are located in this order, and the second radiator is configured such that the feed point, the capacitor, and the inductor are located in this order.

20. A wireless communication apparatus comprising an antenna apparatus comprising at least one radiator and a ground conductor, wherein each radiator comprises:

a looped radiation conductor having an inner perimeter and an outer perimeter, the radiation conductor being positioned with respect to the ground conductor such that a part of the radiation conductor is close to and electromagnetically coupled to the ground conductor;

at least one capacitor inserted at a position along a loop of the radiation conductor;

at least one inductor inserted at a position along the loop of the radiation conductor, the position of the inductor being different from the position of the capacitor; and a feed point provided at a position on the radiation conductor, the position of the feed point being close to the ground conductor, wherein the antenna apparatus is configured such that in a portion where the radiation conductor of each radiator and the ground conductor are close to each other, a distance between the radiation conductor and the ground conductor gradually increases as a distance from the feed point along the loop of the radiation conductor increases, wherein each radiator is excited at a first frequency and at a second frequency higher than the first frequency, wherein when each radiator is excited at the first frequency, a first current flows along a first path, the first path extending along the inner perimeter of the loop of the radiation conductor and including the inductor and the capacitor, wherein when each radiator is excited at the second frequency, a second current flows through a second path including a section, the section extending along the outer perimeter of the loop of the radiation conductor, and the section including the capacitor but not including the inductor, and the section extending between the feed point and the inductor, wherein when each radiator is excited at the second frequency, in the portion where the radiation conductor of each radiator and the ground conductor are close to each other, a resonant circuit is formed from: capacitance distributed between the radiation conductor and the ground conductor; and inductance distributed over the radiation conductor, and wherein each radiator is configured such that the loop of the radiation conductor, the inductor, and the capacitor resonate at the first frequency, and a portion of the loop of the radiation conductor included in the second path, the capacitor, and the resonant circuit resonate at the second frequency.

* * * * *